US010871743B2

(12) United States Patent
Tokiwa et al.

(10) Patent No.: US 10,871,743 B2
(45) Date of Patent: Dec. 22, 2020

(54) CLEANING DEVICE FOR REMOVING A DEVELOPER, PROCESS CARTRIDGE AND IMAGE FORMING APPARATUS

(71) Applicant: CANON KABUSHIKI KAISHA, Tokyo (JP)

(72) Inventors: Shuhei Tokiwa, Tokyo (JP); Takayuki Kanazawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/715,390

(22) Filed: Dec. 16, 2019

(65) Prior Publication Data

US 2020/0201243 A1 Jun. 25, 2020

(30) Foreign Application Priority Data

Dec. 21, 2018 (JP) ..... 2018-240046
Dec. 21, 2018 (JP) ..... 2018-240051

(51) Int. Cl.

| | |
|---|---|
| ***G03G 21/00*** | (2006.01) |
| ***G03G 21/18*** | (2006.01) |
| ***G03G 21/16*** | (2006.01) |
| ***G03G 21/10*** | (2006.01) |

(52) U.S. Cl.

CPC ..... *G03G 21/1814* (2013.01); *G03G 21/10* (2013.01); *G03G 21/169* (2013.01); *G03G 21/1832* (2013.01); *G03G 21/0029* (2013.01); *G03G 2221/1648* (2013.01)

(58) Field of Classification Search

CPC ..... G03G 21/0011; G03G 21/1832
USPC ..... 399/102, 350
See application file for complete search history.

(56) References Cited

U.S. PATENT DOCUMENTS 6,169,867 B1 1/2001 Kurihara
7,599,644 B2 * 10/2009 Kawata ..... G03G 21/0011 399/102
2003/0035668 A1 2/2003 Endo
(Continued)

FOREIGN PATENT DOCUMENTS

CN 101174109 A 5/2008
JP H06130870 A 5/1994
JP 2000330439 A 11/2000
(Continued)

OTHER PUBLICATIONS

Search Report and Written Opinion issued in Singaporean Appln. No. 10201912622S dated Sep. 28, 2020.

*Primary Examiner* — William J Royer
(74) *Attorney, Agent, or Firm* — Rossi, Kimms & McDowell LLP

(57) ABSTRACT

A cleaning device, including: a cleaning frame; a cleaning member having one end and the other end, an image bearing member being capable of rotating and bearing a developer image formed of a developer so as to remove the developer remaining on the image bearing member after transfer of the developer image from the image bearing member; and a sheet member having flexibility and having one end and the other end; wherein a work function W (D) of the developer and a work function W (S) of the sheet member satisfy $0 \leq W(D)-W(S) \leq 0.23$ and the developer includes inorganic particles, and at least one kind of the inorganic particles has an average primary particle diameter of 50 nm or larger.

23 Claims, 10 Drawing Sheets

(56) References Cited

U.S. PATENT DOCUMENTS

| | | | |
|---|---|---|---|
| 2008/0075500 | A1 | 3/2008 | Kawata |
| 2014/0193185 | A1 | 7/2014 | Kami |

FOREIGN PATENT DOCUMENTS

| | | | |
|---|---|---|---|
| JP | 2002023410 | A | 1/2002 |
| JP | 2006251483 | A | 9/2006 |
| JP | 2017062289 | A | 3/2017 |
| WO | 2008001463 | A1 | 1/2008 |

* cited by examiner

CLEANING DEVICE FOR REMOVING A DEVELOPER, PROCESS CARTRIDGE AND IMAGE FORMING APPARATUS

BACKGROUND OF THE INVENTION

Field of the Invention

The present invention relates to a cleaning device for removing a developer that remains of an electrophotographic photosensitive member after transfer of a developer image to a recording medium from the photosensitive member.

Description of the Related Art

Electrostatic recording systems, electrophotographic recording systems and the like are often used conventionally in image forming apparatuses such as copiers and printers. In these image forming apparatuses, an electrostatic latent image is formed on a photosensitive member, and then image forming is performed through transfer of a developer image to a recording material. In such image forming apparatuses, there remains developer that has failed to be transferred from the photosensitive member after transfer, and hence the developer is ordinarily removed by a cleaning device that utilizes for instance an elastic blade. Recent years have witnessed a trend towards the use of developers (toners) of smaller average particle diameter, for the purpose of improving image quality for instance in terms of achieving higher definition.

However, toners of small particle diameter fail to be sufficiently removed in cleaning devices that utilize for instance conventional elastic blades, and in some instances faulty cleaning may occur due to increased slipping of toner between the elastic blade and the photosensitive member. In the image forming apparatus disclosed in Japanese Patent Application Publication No. H06-130870, therefore, a charging device that eliminates the charge of untransferred residual toner is disposed between a cleaning blade and a transfer part that transfers the developer to a recording material.

SUMMARY OF THE INVENTION

In Japanese Patent Application Publication No. H06-130870 the charging device is used in the image forming apparatus; accordingly, the costs involved are greater, and space is required for the charging device, a high-voltage output device and so forth, which entails a larger size of the image forming apparatus. In the charge elimination process of residual toner of Japanese Patent Application Publication No. H06-130870, moreover, only the surface opposing the charge elimination device, in the toner surface, has charge eliminated therefrom, while charge elimination is insufficient on the surface in contact with the photosensitive member. In consequence, a large electrostatic adhesion force to the photosensitive member surface acts on residual toner such as highly charged toner and toner of small particle diameter, and charge is not eliminated at the surface where the toner is adhered to the photosensitive member in the charge elimination device. In turn, this makes removal of the residual toner by the cleaning blade difficult, and may give rise to image defects. In a case where polymerized toner of high circularity is used, scraping of the toner by the cleaning blade is difficult, and therefore image defects are prone to occur in that the toner slips by the cleaning blade.

It is an object of the present invention, arrived at in the light of the above problems, to satisfactorily remove toner on an image bearing member by means of a cleaning member. It is a further object to provide a cleaning device that allows satisfactorily removing of residual toner by means of a cleaning blade, and maintaining good image forming, in a low-cost and small-size configuration, also when using for instance highly charged toner or toner of small particle diameter.

In order to achieve the object described above, a cleaning device according to the present invention including:

a cleaning frame;

a cleaning member having one end attached to the cleaning frame and the other end that is a free end, the cleaning member coming into contact with an image bearing member so as to remove developer remaining on the image bearing member after transfer of a developer image from the image bearing member, the image bearing member being capable of rotating and bearing the developer image formed of the developer; and a sheet member having flexibility and having one end attached to the cleaning frame and the other end that comes into contact with the image bearing member at an upstream side of a contact position between the cleaning member and the image bearing member in a rotation direction of the image bearing member;

wherein a work function W (D) of the developer and a work function W (S) of the sheet member satisfy Expression (A) below, and the developer includes inorganic particles, in which at least one kind of the inorganic particles has an average primary particle diameter of 50 nm or larger.

$$0 \leq W(D) - W(S) \leq 0.23 \quad \text{(A)}$$

In order to achieve the object described above, a process cartridge according to the present invention including:

an image bearing member capable of rotating and bearing a developer image formed of a developer;

a cleaning frame;

a cleaning member having one end attached to the cleaning frame and the other end that is a free end, the cleaning member coming into contact with the image bearing member so as to remove the developer remaining on the image bearing member after transfer of the developer image from the image bearing member; and a sheet member having flexibility and having one end attached to the cleaning frame and the other end that comes into contact with the image bearing member at an upstream side of a contact position between the cleaning member and the image bearing member in a rotation direction of the image bearing member;

wherein a work function W (D) of the developer and a work function W (S) of the sheet member satisfy Expression (A) below and the developer has inorganic particles, in which at least one kind of the inorganic particles has an average primary particle diameter of 50 nm or larger.

$$0 \leq W(D) - W(S) \leq 0.23 \quad \text{(A)}$$

In order to achieve the object described above, an image forming apparatus according to the present invention including:

an image bearing member capable of rotating and bearing a developer image formed of a developer;

a transfer member configured to transfer the developer image borne on the image bearing member to a transferring material;

a cleaning frame;

a cleaning member having one end attached to the cleaning frame and the other end that is a free end and coming into contact with the image bearing member so as to remove the developer remaining on the image bearing member after transfer of the developer image from the image bearing member; and a sheet member having flexibility, and having one end attached to the cleaning frame and the other end that comes into contact with the image bearing member at an upstream side of a contact position between the cleaning member and the image bearing member in a rotation direction of the image bearing member;

wherein a work function W (D) of the developer and a work function W (S) of the sheet member satisfy Expression (A) below and the developer has inorganic particles, in which at least one kind of the inorganic particle has an average primary particle diameter of 50 nm or larger.

$$0 \leq W(D) - W(S) \leq 0.23 \quad \text{(A)}$$

In order to achieve the object described above, a cleaning device according to the present invention including:

a cleaning frame;

a cleaning member having one end attached to the cleaning frame and the other end that is a free end, the cleaning member coming into contact with an image bearing member so as to remove developer remaining on the image bearing member after transfer of a developer image from the image bearing member, the image bearing member being capable of rotating and bearing the developer image formed of the developer;

a charging member, which is attached to the cleaning frame and which charges the image bearing member; and a sheet member having flexibility and having one end attached to the cleaning frame and the other end that comes into contact with the image bearing member at an upstream side of a contact position between the cleaning member and the image bearing member in a rotation direction of the image bearing member;

wherein an AC voltage is applicable to the charging member; and a work function W (D) of the developer and a work function W (S) of the sheet member satisfy Expression (A) below.

$$0 \leq W(D) - W(S) \leq 0.23 \quad \text{(A)}$$

In order to achieve the object described above, a cartridge attachable to and detachable from a main body of an image forming apparatus according to the present invention, the cartridge including:

an image bearing member capable of rotating and bearing a developer image formed of a developer;

a cleaning frame;

a cleaning member having one end attached to the cleaning frame and the other end that is a free end, the cleaning member coming into contact with the image bearing member so as to remove the developer remaining on the image bearing member after transfer of the developer image from the image bearing member;

a charging member attached to the cleaning frame and which charges the image bearing member; and a sheet member having flexibility and having one end attached to the cleaning frame and the other end that comes into contact with the image bearing member at an upstream side of a contact position between the cleaning member and the image bearing member in the rotation direction of the image bearing member;

wherein an AC voltage is applicable to the charging member; and a work function W (D) of the developer and a work function W (S) of the sheet member satisfy Expression (A) below.

$$0 \leq W(D) - W(S) \leq 0.23 \quad \text{(A)}$$

In order to achieve the object described above, an image forming apparatus according to the present invention including:

an image bearing member capable of rotating and bearing a developer image formed of a developer;

a transfer member that transfers the developer image borne on the image bearing member to a transferring material;

a cleaning frame;

a cleaning member having one end attached to the cleaning frame and the other end that is a free end, the cleaning member coming into contact with the image bearing member so as to remove the developer remaining on the image bearing member after transfer of the developer image from the image bearing member;

a charging member attached to the cleaning frame and which charges the image bearing member; and a sheet member having flexibility and having one end attached to the cleaning frame and the other end that comes into contact with the image bearing member at an upstream side of a contact position between the cleaning member and the image bearing member in a rotation direction of the image bearing member;

wherein an AC voltage is applicable to the charging member; and a work function W (D) of the developer and a work function W (S) of the sheet member satisfy Expression (A) below.

$$0 \leq W(D) - W(S) \leq 0.23 \quad \text{(A)}$$

The present invention allows removing satisfactorily toner on an image bearing member by means of a cleaning member.

The present invention allows removing satisfactorily residual toner by means of a cleaning blade, and maintaining good image forming over long periods of time, in a low-cost and small-size configuration, also when using for instance highly charged toner or toner of small particle diameter.

Further features of the present invention will become apparent from the following description of exemplary embodiments with reference to the attached drawings.

DESCRIPTION OF THE EMBODIMENTS

Embodiments of the present invention will be explained in detail below with reference to accompanying drawings. The dimensions, materials, shapes, relative arrangement positions and so forth of constituent parts described in the embodiments are to be modified as appropriate depending on the configuration of the apparatus to which the invention is to be applied, and depending on various conditions. That is, the scope of the present invention is not meant to be limited to the embodiments below.

EMBODIMENTS

Overview of Image Forming Apparatus

Figure 1:
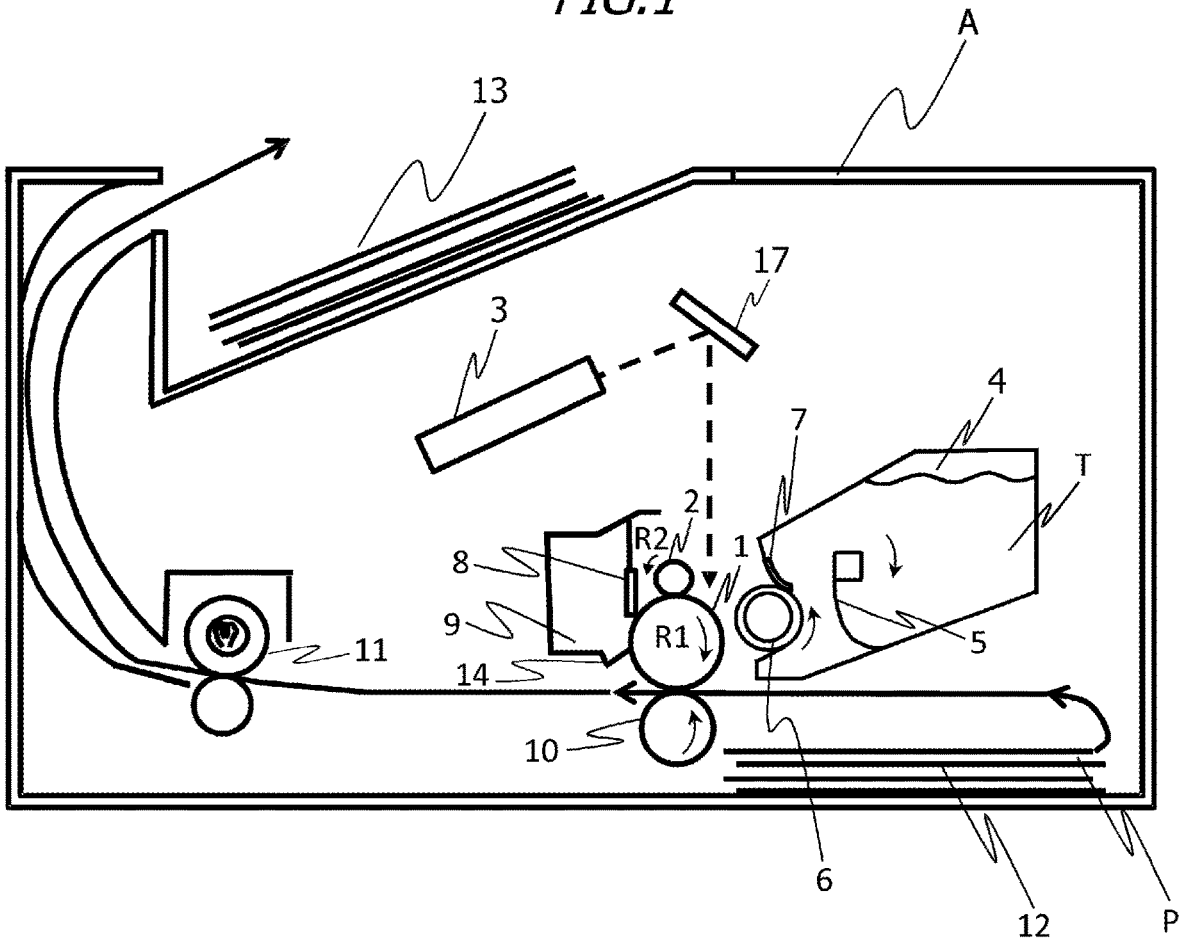
FIG. 1 is a schematic cross-sectional diagram of an image forming apparatus.

An image forming process in an image forming apparatus used in the embodiments will be explained next, together with members of the image forming apparatus, with reference to FIG. 1. A recording material (sheet) P of paper or the like is transported by a transport roller (not shown) from a sheet cassette 12 of a main body A of the image forming apparatus, and a photosensitive drum 1, which is a rotatable image bearing member, is charged by a charging roller 2, which is a rotatable charging means, in synchrony with the transport of the recording material (transferring material) P. Thereafter, the photosensitive drum 1 is selectively exposed by an exposure device 3, to thereby form an electrostatic latent image on the photosensitive drum 1. The photosensitive drum 1 and the charging roller 2 are rotating members, with the photosensitive drum 1 rotating in the direction of arrow R1 and the charging roller 2 rotating in the direction of arrow R2. A laser emitted by the exposure device 3 is reflected by a polygon mirror 17, whereby the surface of the photosensitive drum 1 becomes exposed in a main scanning direction and a sub-scanning direction.

A magnetic single-component developer T (hereafter also notated as toner) accommodated in a developer accommodating chamber 4 is supplied, by a stirring member 5, to a developer bearing member (hereafter referred to as developing sleeve) 6. The developing sleeve 6 is a hollow rotating member and has, in the interior thereof, a magnet roller (not shown) which is a transport member. The toner is borne and transported on the surface of the developing sleeve 6 by the magnetic force of the magnet roller. A thin layer of a desired amount of the magnetic single-component developer T is caused to be borne on the surface of the developing sleeve 6, by a developing blade 7.

Next, a developing bias is applied to the developing sleeve 6, as a result of which toner becomes supplied to the photosensitive drum 1, and a toner image (developer image) according to the latent image on the photosensitive drum 1 is developed. The photosensitive drum 1 bears therefore a toner image formed of toner. The toner image becomes transferred to the transported recording material P through application of a bias to a transfer roller 10 as a transfer member. The recording material P is transported to a fixing apparatus 11, where the toner image is fixed to the recording material P; thereupon, the recording material P is discharged to a paper output unit 13 at the top of the image forming apparatus, by a paper output roller (not shown).

Herein toner after transfer is over (untransferred toner) remains on the photosensitive drum 1. The toner on the photosensitive drum 1 is removed by a cleaning member (cleaning blade) 8 having elasticity. The removed toner is accommodated in a recovery container (accommodating container) 9 which is an accommodating part. Leakage of toner accommodated in the recovery container 9 to the exterior is prevented by a recovery sheet member (sheet member) 14 which is a sealing member.

Process Cartridge

Figure 2A:
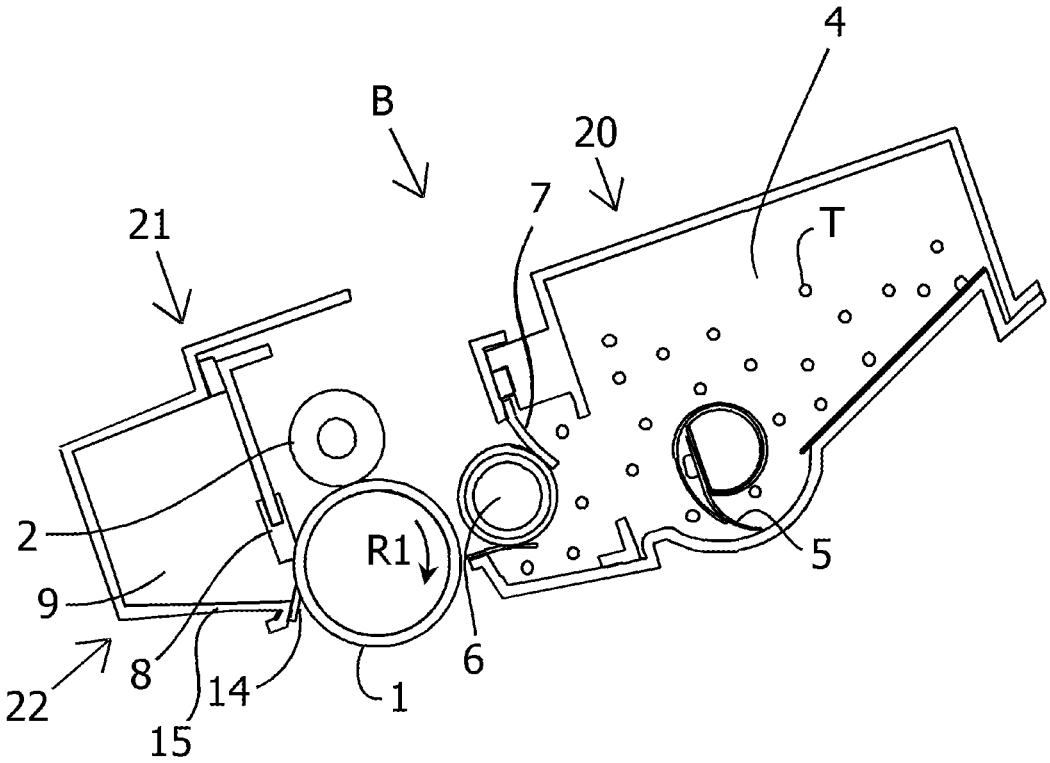
FIG. 2A is a schematic cross-sectional diagram of a process cartridge.

The overall structure of a process cartridge B will be explained next with reference to FIG. 2A. The process cartridge B has a photosensitive member unit 21 having for instance a photosensitive drum 1, and a developing unit (developing apparatus) 20 having for instance a developing sleeve 6. The process cartridge B is attachable to and detachable from the main body A of the image forming apparatus. The photosensitive member unit 21 has the photosensitive drum 1 and a cleaning device 22 for removing residual toner remaining on the photosensitive drum 1. The cleaning device 22 has the charging roller 2, a cleaning member 8, recovery container 9, a recovery sheet member 14 as a recovery member, and a frame (cleaning frame) 15 of the recovery container 9. Residual toner on the surface of the photosensitive drum 1 is removed through contact of the cleaning member 8 with the photosensitive drum 1.

The photosensitive drum 1 is rotatably attached to the photosensitive member unit 21 via a bearing not shown. The photosensitive drum 1 receives a driving force of a driving motor, not shown, and is rotationally driven as a result in the direction of arrow R1 in FIG. 2A, according to an image forming operation. The photosensitive member unit 21 has the charging roller 2, the cleaning member 8, the recovery sheet member 14 and the recovery container 9. The charging roller 2, the cleaning member 8 and the recovery sheet member 14 are disposed so as to be each in contact with the photosensitive drum 1.

The photosensitive drum 1 has a diameter of 24 mm and includes a charge transport layer, a charge generation layer, an undercoat layer and an aluminum cylinder. The rotational speed of the photosensitive drum 1 is for instance 200 mm/sec.

Figure 2B:
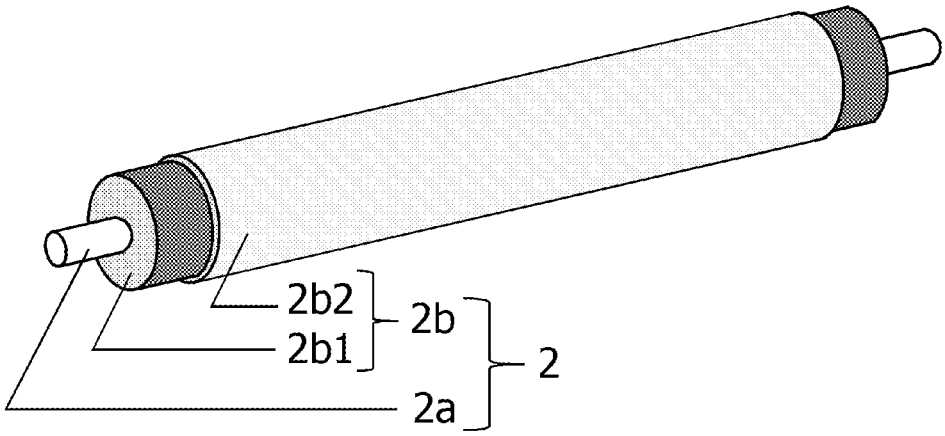
FIG. 2B is a perspective-view diagram of a charging roller.

FIG. 2B illustrates a perspective-view diagram of a charging roller 2 according to the Embodiments. The charging roller 2 has a structure having, at the center, a shaft 2*a* made of a metal core, and layers 2*b* including a resistance adjustment layer 2*b*1 on the outer side of the shaft 2*a*, and a surface layer 2*b*2 at the outermost layer. The shaft 2*a* is made for instance of a conductive metal of high rigidity, such as stainless steel or aluminum, having a diameter of 8 to 20 mm, but may be formed of, for instance, a high-rigidity conductive resin having $1\times10^3$ Ω·cm or less, preferably $1\times10^2$ Ω·cm or less.

Preferably, the resistance adjustment layer 2*b*1 is set to have a volume resistivity of $1\times10^5$ Ω·cm to $1\times10^9$ Ω·cm, and a thickness of about 1 to 2 mm.

Preferably, the surface layer 2*b*2 is set to have a volume resistivity of $1\times10^6$ Ω·cm to $1\times10^{12}$ Ω·cm, and a thickness of about 10 μm. The volume resistivity of the surface layer is preferably higher than the electrical resistivity of the resistance adjustment layer 2*b*1. The charging roller 2 exhibits a two-layer structure, namely the resistance adjustment layer 2*b*1 and the surface layer, but is not particularly limited to such a structure, and may be a single layer or three layers.

The resistance adjustment layer 2*b*1 is formed by providing a rubber material such as foamed urethane rubber, silicone rubber or hydrin rubber, on the peripheral surface of the shaft 2*a*, for instance by extrusion molding or injection molding of a resin composition. The resistance adjustment layer 2*b*1 has a JIS-D hardness of 45 degrees or more, in order to prevent the resistance adjustment layer 2*b*1 from deforming over time and prevent thus changes in the clearance between the photosensitive drum 1 and the charging roller 2.

The thermoplastic resin used in the surface layer 2*b*2 is not particularly limited, so long as the JIS-D hardness after molding can be maintained. It is however preferable to use a general-purpose resin such as polyethylene (PE), polypropylene (PP), polymethyl methacrylate (PMMA), polystyrene (PS) or copolymers thereof (AS, ABS and the like), since in that case the molding process is easier.

A conductive material such as a polymeric ionic conducting agent, carbon black or a metal powder can be used in order to adjust electric resistance.

The charging roller 2 is connected to a power supply unit as a voltage application means, and is configured to be capable of applying a predetermined voltage. In the present invention, AC voltage is supplied as the voltage of the power supply unit. Preferably, the voltage results from superimposing AC voltage on DC voltage. In the embodiments, the AC voltage is a sine wave, but is not limited thereto, and may be a waveform such as a square wave. The surface of the photosensitive drum 1 can be charged uniformly through application of AC voltage. In the embodiments, AC voltage is superimposed on DC voltage.

The charging roller 2 is formed of a conductive sponge-like rubber material, and rolls on the surface of the photosensitive drum 1 by being urged by an urging spring, not shown. The surface of the photosensitive drum 1 becomes charged with uniform potential through application, onto the charging roller 2, of charging voltage resulting from superposition of DC voltage on AC voltage from a charging power supply, not shown, included in a charging means.

Specifically, the surface of the photosensitive drum 1 can be charged uniformly to −400 V through application, to the charging roller 2, of charging voltage resulting from superposition of AC voltage having a peak-to-peak voltage value, Vpp, of 1500 V, onto DC voltage of −400 V. The peak value of the peak-to-peak voltage applied to the charging roller 2 in Embodiment 1 is the amplitude (peak to peak) of a sine wave, and similarly denotes amplitude (peak to peak) also in the case of a square wave. The charging roller 2 rolls on the surface of the photosensitive drum 1 by being urged by an urging spring, not shown, to charge the photosensitive drum 1, and hence is a charging device of contact type. As compared with corona charging schemes conventionally resorted to, charging devices of contact type are advantageous for instance from the viewpoint of very small generation amounts of emission products, lower power supply costs thanks to the low applied voltage, and easier design of electrical insulation. Also, problems such as ozone and nitrogen oxide are reduced in that case, as a matter of course.

The thickness of a metal support that makes up the cleaning member 8 is for instance 1.2 mm to 2.0 mm, and the hardness of polyurethane rubber is for instance 60° to 80° (Wallace hardness). Herein a tip-hardened blade resulting from hardening the portion of polyurethane rubber that is in contact with the photosensitive drum 1 can be used as the polyurethane rubber. The cleaning member 8 removes toner remaining on the photosensitive drum 1 after transfer of the toner image onto the recording material P from the photosensitive drum 1. The toner removed by the cleaning member 8 is held in the recovery container 9. One end of the cleaning member 8 is a fixed end that is attached to the frame 15, and the other end of the cleaning member 8 is a free end in contact with the photosensitive drum 1. The other end (free end) of the cleaning member 8 extends along the rotation direction of the photosensitive drum 1 from the downstream side to the upstream side, and is in contact with the photosensitive drum 1. The direction along which one end (fixed end) of the cleaning member 8 extends towards the other end (free end) thereof is the reverse of the rotation direction of the photosensitive drum 1 at a region at which the other end of the cleaning member 8 is in contact with the photosensitive drum 1.

Recovery Sheet Member

The recovery sheet member 14 will be explained next. As illustrated in FIG. 2A, the recovery sheet member 14 is a constituent element of the photosensitive member unit 21 that has the photosensitive drum 1, the charging roller 2, the cleaning member 8 and the recovery container 9. The recovery sheet member 14 has flexibility. The recovery sheet member 14 is disposed upstream of the cleaning member 8, in the rotation direction of the photosensitive drum 1. After transfer of the toner image to the recording material P, the toner remaining on the photosensitive drum 1 is removed by the cleaning member 8, and becomes thereupon accommodated in the recovery container 9. The recovery sheet member 14 collects the removed toner into the recovery container 9, and prevents the toner accommodated in the recovery container 9 from leaking out of the recovery container 9.

The recovery sheet member 14 is joined to a joining surface of the frame 15 that makes up the recovery container 9, for instance via a double-sided tape or by laser welding. The recovery sheet member 14 extends in the axial direction of the rotation center of the photosensitive drum 1, and is joined to the frame 15, so as to be in contact with the photosensitive drum 1. One end of the recovery sheet member 14 is a fixed end attached to the frame 15, and the other end of the recovery sheet member 14 is a free end in contact with the photosensitive drum 1. With the recovery sheet member 14 joined to the frame 15, the other end (free end) of the recovery sheet member 14 extends along the rotation direction of the photosensitive drum 1, from the upstream side towards the downstream side, and is in contact with the photosensitive drum 1. The direction along which one end (fixed end) of the recovery sheet member 14 extends towards the other end (free end) thereof is substantially the same direction as the rotation direction of the photosensitive drum 1, at a region at which the other end of the recovery sheet member 14 is in contact with the photosensitive drum 1. The recovery sheet member 14 is in contact with the outer peripheral surface of the photosensitive drum 1 at an upstream side of the contact position between the cleaning member 8 and the photosensitive drum 1 in the rotation direction of the photosensitive drum 1. The recovery sheet member 14 plugs the gap between the photosensitive drum 1 and the frame 15, so as to prevent the toner accommodated in the recovery container 9 from leaking out into the gap between the photosensitive drum 1 and the frame 15. The cleaning member 8 is in contact with the photosensitive drum 1 in a counter direction (reverse direction) of the rotation direction (R1 direction) of the photosensitive drum 1, while the recovery sheet member 14 is in contact with the photosensitive drum 1 in the rotation direction thereof. The space across which the cleaning member 8 and the recovery sheet member 14 oppose each other communicates with the interior of the recovery container 9, and accordingly the toner removed from the photosensitive drum 1 becomes accommodated in the recovery container 9 without leaking out of the recovery container 9 through the gap between the photosensitive drum 1 and the frame 15.

Embodiment 1

Embodiment 1 will be explained next. The following materials are used as the recovery sheet member 14 of Embodiment 1.

Material (Base Material): polyphenylene sulfide (PPS) sheet

Thickness: 38 μm

Work function: 5.80 eV

Young's modulus: 3000 N/m$^2$

Poisson's ratio: 0.38

The contact conditions of the recovery sheet member 14 with the photosensitive drum 1 are given below. The recovery sheet member 14 is joined to the frame 15 by laser welding.

Penetration amount: 3.4 (μm)

Setting angle: 28.6)(°)

Deflection amount δ: 1.24 (mm)

Contact pressure: $8.72\times10^{-4}$ (N/mm)

The penetration amount and the setting angle will be explained next with reference to FIG. 3.

Figure 3:
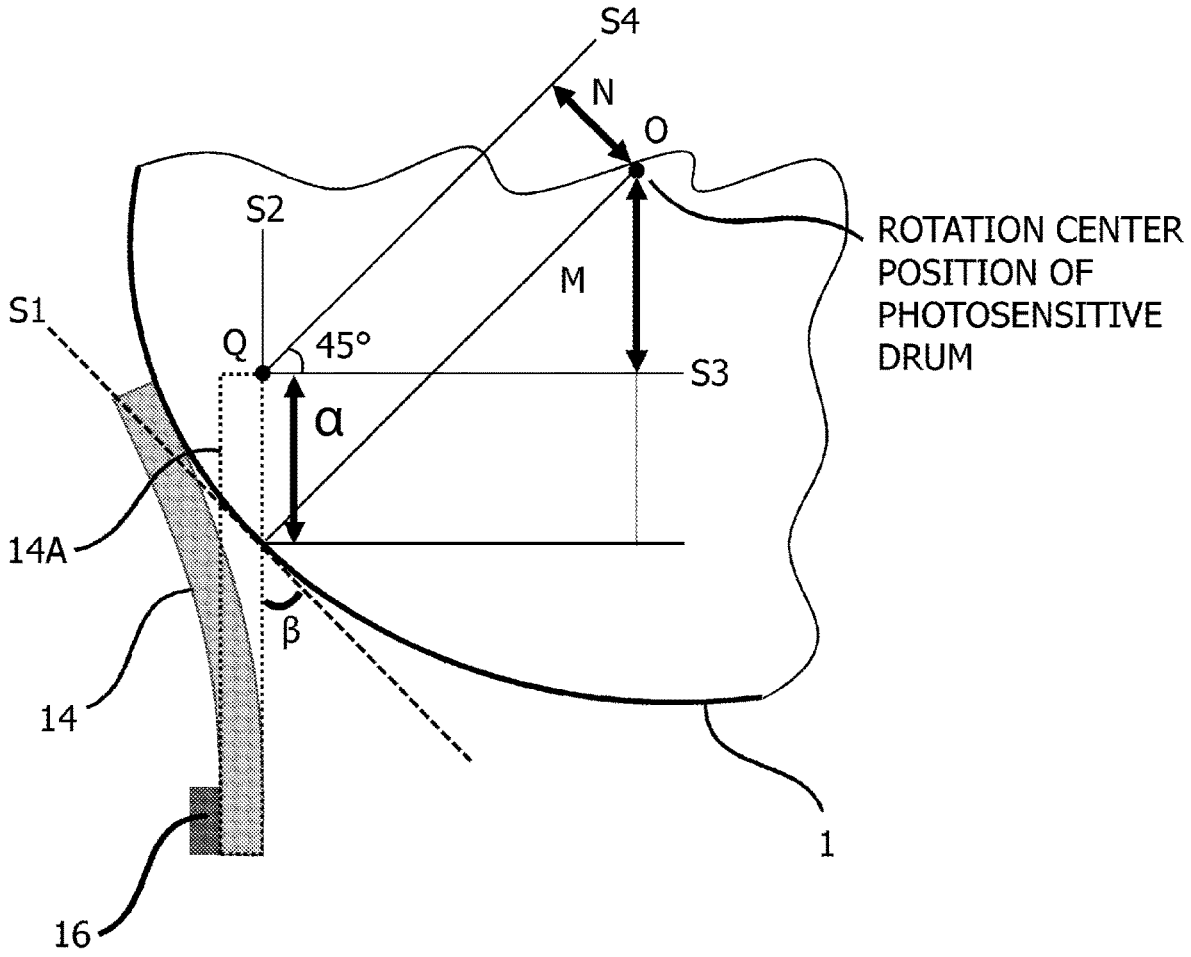
FIG. 3 is an explanatory diagram of a penetration amount and a setting angle of a recovery sheet member.

The reference symbol α illustrated in FIG. 3 is defined as the penetration amount (mm) and the reference symbol β is defined as the setting angle (°). The penetration amount α denotes the degree by which the recovery sheet member 14 would penetrate into the outline of the photosensitive drum 1 in a hypothetical state where the photosensitive drum 1 were absent. Specifically, the penetration amount α is the distance from the surface of the photosensitive drum 1 to the free end (tip) of the recovery sheet member 14 in the case of hypothetical absence of the photosensitive drum 1. The recovery sheet member 14 in the case of hypothetical absence of the photosensitive drum 1 will be referred to as recovery sheet member 14A. Further, the setting angle β is the angle formed between the recovery sheet member 14A and a tangent 51 on the photosensitive drum 1, at the intersection between the recovery sheet member 14A and the outline of the photosensitive drum 1 in the case of hypothetical absence of the photosensitive drum 1. Next, M is defined as the distance between a straight line S3 having point Q as a starting point and extending perpendicularly to a straight line S2 that extends from the fixed end towards the free end of the recovery sheet member 14A along the recovery sheet member 14A, and the center point (rotation center position) O of the photosensitive drum 1. The point Q is an arbitrary point on the edge of the free end (tip) of the recovery sheet member 14A, on the center point O side of the photosensitive drum 1. Further, N is defined as the distance between point O and a straight line S4 having point Q as a starting point and forming an angle of 45°, on the recovery container 9 side, with the straight line S3 that is perpendicular to the straight line S2 having point Q as a starting point. The penetration amount α and the setting angle β can be calculated by measuring the distances M and N and plugging the obtained values in Expression 1 and Expression 2 below. The reference symbol r denotes the radius (mm) of the photosensitive drum 1.

$$\alpha = \sqrt{r^2 - \left(\sqrt{2}\times N\times M\right)^2} - M \qquad \text{(Expression 1)}$$

$$\beta = \sin^{-1}\left\{\frac{\sqrt{r^2 - \left(\sqrt{2}\times N + M\right)^2}}{r}\right\}\times\frac{180}{\pi} \qquad \text{(Expression 2)}$$

The method for calculating contact pressure will be explained next with reference to FIG. 4.

Figure 4:
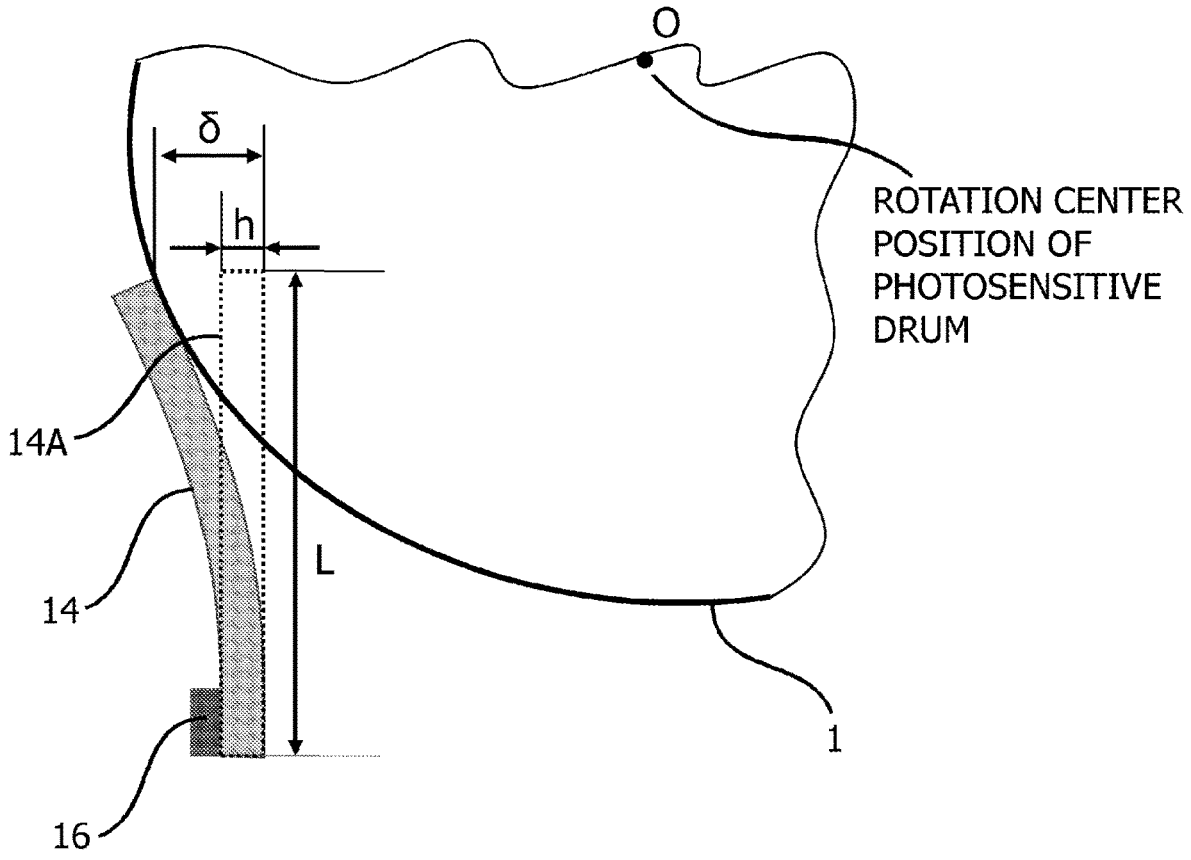
FIG. 4 is an explanatory diagram of a method for calculating the contact pressure of a recovery sheet member.

In FIG. 4 the free end (tip) of the recovery sheet member 14 joined and fixed to a seat surface 16 is in contact with the photosensitive drum 1, and the recovery sheet member 14 is bent as a result. The contact pressure P (N) on the photosensitive drum 1 by a very thin recovery sheet member 14 such as those used in image forming apparatuses, per unit length (1 mm) in the longitudinal direction, is preferably at least $1.32\times10^{-5}$ and not more than $1.74\times10^{-2}$. The calculated value of the contact pressure P (N) is worked out through a calculation in which the assessment conditions below are applied to Expression (3), using a general expression of deflection and load exerted on a cantilever spring.

Herein 6 (mm) denotes the deflection amount of the recovery sheet member 14, L (mm) denotes the distance (free length) from the fixed end of the recovery sheet member 14 up to the contact nip (contact position) of the free end of the recovery sheet member 14 and the photosensitive drum 1, and h (mm) denotes the thickness of the recovery sheet member 14. Further, E denotes the Young's modulus (N/mm$^2$) of the recovery sheet member 14 and v denotes the Poisson's ratio of the recovery sheet member 14.

$$P=\delta Eh^3/\{4L^3(L-v^2)\} \qquad \text{(Expression 3)}$$

Substantially the tip of the recovery sheet member 14 is in contact with the photosensitive drum 1. Accordingly, the distance L from the fixed end of the recovery sheet member 14 up to the contact nip between the photosensitive drum 1 and the free end of the recovery sheet member 14 is used herein approximated by the distance from the fixed end up to the free end of the recovery sheet member 14. Similarly, the deflection amount δ of the recovery sheet member 14 is used herein approximated by the distance between the contact portion of the free end of the recovery sheet member 14 with the photosensitive drum 1 and the edge of the free end of the recovery sheet member 14A, on the center point O side of the photosensitive drum 1.

The present invention was assessed for study conditions within the ranges given below.

Radius of photosensitive drum 1=12 (mm);

Distance M=1.69 to 3.06 (mm)

Distance N=5.31 to 6.30 (mm)

Penetration amount δ=2.62 to 4.13 (mm)

Thickness h of recovery sheet member 14=10 to 100 (μm)

Free length L of recovery sheet member 14=3.39 to 4.79 (mm)

Toner

A binder of the toner used in Embodiment 1 is a styrenic resin, and a release agent of the toner is an ester compound. The ester compound acts moderately on the styrene resin, thereby softening the resin. Ester compounds have a high sharp melt property, and accordingly ester compounds that are present without intermixing with the styrenic resin melt quickly at a fixing region. A crystalline polyester is finely dispersed in the toner, in order to enhance the low-temperature fixing performance of the toner. The toner particle as a whole can be plasticized quickly through uniform dispersion of a highly crystalline polyester into the toner. In order to finely disperse the crystalline polyester, it is important that crystal nuclei of the ester compound be formed in large amounts within the toner particle. Accordingly, the degree of crystallinity of the ester compound must be curtailed to a certain extent. By virtue of the fact that the composition of the ester compound has a distribution, the crystallization rate of the ester compound is lower, and crystal nuclei can be generated in larger amounts, than in the case of an ester compound of single composition. Therefore, the composition of the ester compound preferably has a distribution.

An inorganic substance as an external additive may be added to the toner surface, in order to modify the surface of the toner. That is, the toner may contain an external additive. Examples of substances that can be used as the inorganic substance formed on the toner surface include silica, alumina, titanium oxide, aluminum oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. These inorganic substances may be used singly or in combinations of two or more types. Preferably, the inorganic substance formed on the toner surface is adhered to the toner surface in the form of inorganic fine particles (inorganic particles).

In Embodiment 1, a magnetic toner having negative charging performance and produced in accordance with a suspension polymerization method is used, and the number average particle diameter of the magnetic toner being about 8 μm. Toner produced by suspension polymerization is used in Embodiment 1, but the invention is not limited thereto. For instance, toner produced in accordance with some other polymerization method such as a pulverization method or emulsion polymerization may be likewise used. The number average particle diameter of the toner is measured herein using a precision particle size distribution measuring device Multisizer 3, by Beckman Coulter Inc.

In Embodiment 1, silicon oxide particles and titanium oxide particles are used as the inorganic substance formed on the surface of the toner, such that the silicon oxide particles and the titanium oxide particles are caused to adhere uniformly to the surface of the toner. In Embodiment 1, about 1.5%, in toner weight, of silicon oxide particles having a number average particle diameter of about 20 nm, and about 0.8% of silicon oxide particles, in toner weight, plus about 0.1% of titanium oxide particles, in toner weight, having a number average particle diameter of about 50 nm are used.

The work function of the toner used in Embodiment 1 is 6.03 eV. The details of the method for measuring the work function of the toner will be described further on. The types and amounts of inorganic substances formed on the toner surface in other examples, as well as the toner work function in these examples, will be explained in each respective example.

An explanation follows next on Comparative examples 1 to 5 for verifying the effect of Embodiment 1, and on Embodiments 2 to 4 of the present invention. The features in Comparative examples 1 to 5 and Embodiments 2 to 4 are substantially identical to those of Embodiment 1, except for the points particularly explained below. In Comparative examples 1 to 5 and Embodiments 2 to 4, functions and constituent elements corresponding to Embodiment 1 will be denoted by identical reference symbols.

Comparative Example 1

Comparative example 1 differs from Embodiment 1 in that herein the number average particle diameter of the silicon oxide particles formed on the toner surface is modified. In Comparative example 1, the number average particle diameter is about 20 nm, and about 1.5% of silicon oxide particles, in toner weight, is uniformly adhered to the surface of the toner.

Comparative Example 2

Comparative example 2 differs from Embodiment 1 in that herein the number average particle diameter of the silicon oxide particles formed on the toner surface is modified. In Comparative example 2, the number-average particle diameter is about 30 nm, and about 1.5% of silicon oxide particles, in toner weight, is uniformly adhered to the surface of the toner.

Comparative Example 3

Comparative example 3 differs from Embodiment 1 in that herein the material of the recovery sheet member 14 and the material of a toner base are modified. The materials of the recovery sheet member 14 and of the toner in Comparative example 3 are given below.

Recovery Sheet Member 14

Material (Base Material): PET sheet (by Toray Industries, Inc.: Lumirror (registered trademark))

Thickness: 38 (μm)

Work function: 5.33 (eV)

Flexural elasticity modulus: 2000 ($N/m^2$)

Poisson's ratio: 0.21

The contact conditions of the recovery sheet member 14 with the photosensitive drum 1 are given below. The recovery sheet member 14 is joined to the frame 15 by laser welding.

Penetration amount: 3.4 (μm)

Setting angle: 28.6 (°)

Deflection amount δ: 1.24 (mm)

Contact pressure: $5.20\times10^{-4}$ (N/mm)

Toner

The binder resin of the magnetic toner of Comparative example 3 is a styrenic resin, and the release agent is an ester compound. Comparative example 3 differs from Embodiment 1 in that in Comparative example 3 no crystalline polyester is added. The work functions of the toners in Embodiment 1 and Comparative example 3 differ since the materials used in the respective toner bases are different from each other. The work function of the toner of Comparative example 1 is 5.65 eV.

In Comparative example 3, silicon oxide particles are used as the inorganic fine particles (external additive) formed on the toner surface, with about 1.5% of silicon oxide particles, in toner weight, having a number average particle diameter of about 50 nm being uniformly adhered to the surface of the toner.

Comparative Example 4

Comparative example 4 differs from Embodiment 1 in that herein the material of the recovery sheet member 14 is modified.

Recovery Sheet Member 14

Material (Base Material): PET sheet (by Toray Industries, Inc.: Lumirror (registered trademark))

Thickness: 38 (μm)

Work function: 5.33 (eV)

Flexural elasticity modulus: 2000 ($N/m^2$)

Poisson's ratio: 0.21

The contact conditions of the recovery sheet member 14 with the photosensitive drum 1 are given below. The recovery sheet member 14 is joined to the frame 15 by laser welding.

Penetration amount: 3.4 (μm)

Setting angle: 28.6 (°)

Deflection amount δ: 1.24 (mm)

Contact pressure: $5.20\times10^{-4}$ (N/mm)

Comparative Embodiment 5

Comparative example 5 differs from Embodiment 1 in that the conditions of the toner base are modified to conditions identical to those of Comparative example 3.

Embodiment 2

Embodiment 2 differs from Embodiment 1 in that herein the material of the recovery sheet member 14 is modified.

Recovery Sheet Member 14

Material (Base Material): polytetrafluoroethylene (PTFE) sheet (Teflon (registered trademark))

Thickness: 50 (μm)

Work function: 6.0 (eV)

Flexural elasticity modulus: 560 ($N/m^2$)

Poisson's ratio: 0.46

The contact conditions of the recovery sheet member 14 with the photosensitive drum 1 are given below. The recovery sheet member 14 is joined to the frame 15 by laser welding.

Penetration amount: 3.4 (μm)

Setting angle: 28.6 (°)

Deflection amount δ: 1.24 (mm)

Contact pressure: $4.02\times10^{-4}$ (N/mm)

Embodiment 3

Embodiment 3 differs from Embodiment 1 in that the method for joining the recovery sheet member 14 to the frame 15 is modified.

In Embodiment 3, a double-sided tape is affixed to the frame 15, and the recovery sheet member 14 is provided on the double-sided tape, to thereby fix the recovery sheet member 14 to the frame 15. The contact conditions of the recovery sheet member 14 with the photosensitive drum 1 are given below.

Penetration amount: 4.9 (μm)

Setting angle: 37.3 (°)

Deflection amount δ: 2.24 (mm)

Contact pressure: $1.57\times10^{-3}$ (N/mm)

Embodiment 4

Embodiment 4 differs from Embodiment 1 in that the thickness of the recovery sheet member 14 is modified. In Embodiment 4, a PPS sheet having a thickness of 60 μm is fixed to the frame 15 by laser welding. The contact conditions of the recovery sheet member 14 with the photosensitive drum 1 are given below.

Penetration amount: 3.4 (μm)

Setting angle: 28.7 (°)

Deflection amount δ: 1.24 (mm)

Contact pressure: $1.99\times10^{-3}$ (N/mm)

Combinations of Recovery Sheet Member and Toner

Combinations of toner and the recovery sheet member 14, which are the point of the present invention, will be explained next. The inventors found that the magnitude relation between the work functions of the recovery sheet member 14 and of the toner affects significantly the cleaning performance of the toner remaining on the photosensitive drum 1. An evaluation method and evaluation results are explained in detail next.

Evaluation Method in Embodiments and Comparative Examples

Work Function Measurement

Focusing on the positional relationship of the recovery sheet member 14 and toner in a triboelectric series, in the present invention three types of recovery sheet member 14 and two types of toner (A and B) used in experiments were evaluated on the basis of respective work functions measured in accordance with the below-described measuring method. The work function (Φ) of a substance is the energy required to extract electrons from the substance. In a case where a difference in the work functions of two members is large, the electric field generated by triboelectric charging between the two members is large, while in a case where the difference in the work functions of the two members is small, the electric field generated by triboelectric charging between the two members is small.

Method for Measuring Work Function

The work function can be measured in accordance with the measuring method below. The work function, which is quantified as the energy (eV) for extracting electrons from a substance, allows evaluating the charging polarity of the recovery sheet member 14 and of the toner.

The work function (Φ) is measured herein using a surface analyzer (AC-2, by Riken Keiki Co., Ltd.). In the surface analyzer a deuterium lamp is used, an irradiation light amount is set as appropriate, and monochromatic light is selected by a spectrometer and is projected onto a sample, to a spot size of 4 (mm)×4 (mm), over an energy operation range of 3.4 to 6.2 (eV), and for a measurement time of 10 (sec/l point). Photoelectrons emitted from the sample surface are detected and are computed by a work function meter software built into the surface analyzer, to thereby measure the work function. The work function is measured with a repeatability (standard deviation) of 0.02 (eV). The work functions of the recovery sheet member 14 and of the toner are measured in a state prior to image formation. The measurement is performed after removal, by air blowing, of dirt on the surface of the recovery sheet member 14. In order to ensure data reproducibility, after image forming the recovery sheet member 14 is allowed to stand for 24 hours under conditions of use temperature of 25° C. and humidity 55% RH, to yield a measurement sample.

To measure a sheet-shaped sample, such as the recovery sheet member 14, measurement light is projected to a 4 (mm)×4 (mm) spot; hence, the sample piece as a sample is cut to a size of at least 1 (cm)×1 (cm), and the resulting test piece is fitted to a sample stand, whereupon the measurement is carried out. In the case of measurement of a powdery sample such as toner, the toner is laid smoothly, without gaps, on a shallow dish-like container having a size of at least 1 (cm)×1 (cm), and the container is fixed to a sample stand, to perform the measurement.

Figure 5:
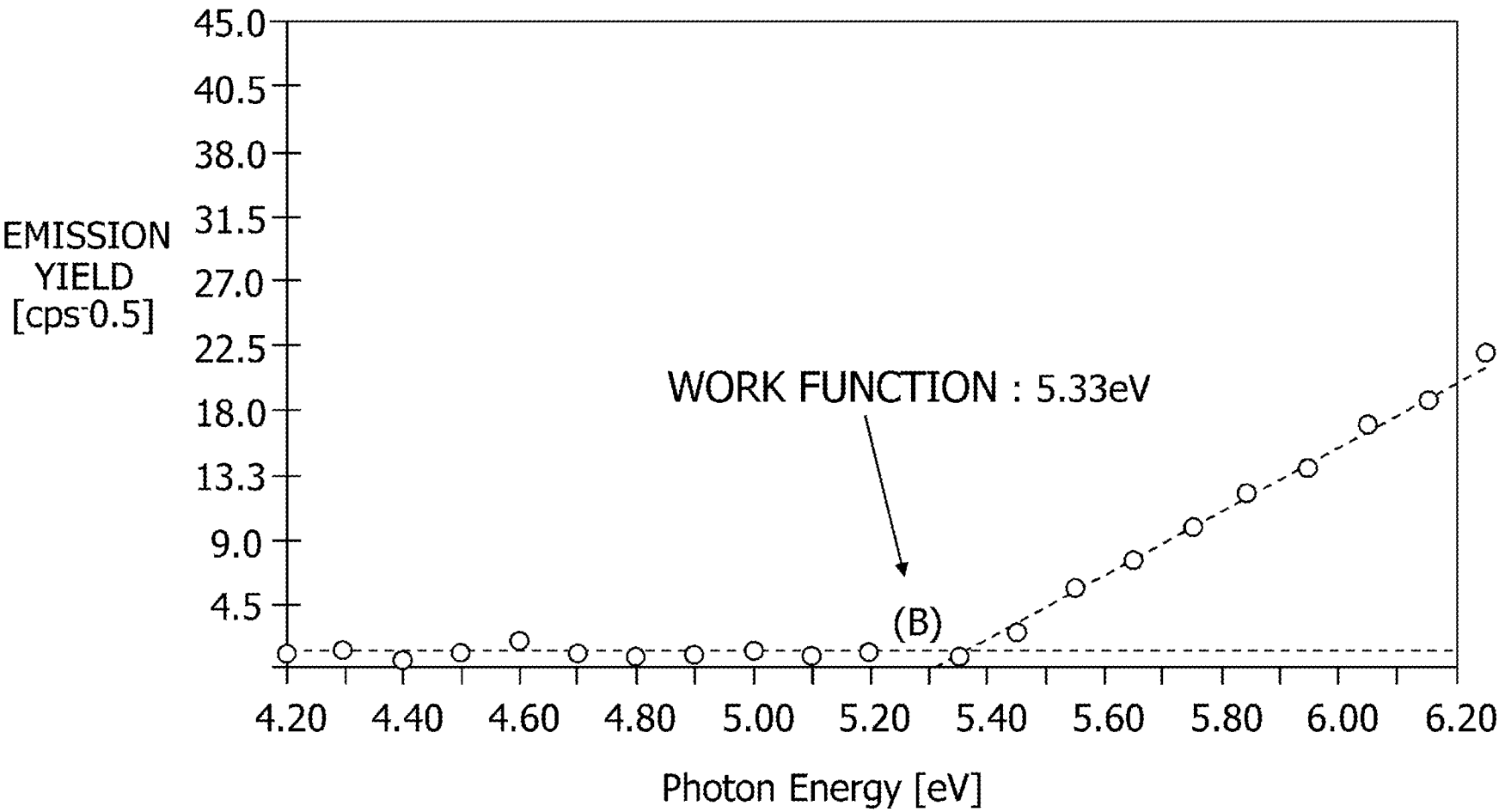
FIG. 5 is a graph illustrating measurement results of the work functions of a recovery sheet member and of toner.

Upon scanning from low to high excitation energy of the monochromatic light in the surface analyzer, emission of photons starts from a predetermined energy value (eV). This predetermined energy value is taken as the work function (eV). FIG. 5 illustrates an example of a graph of the work function of the recovery sheet member 14, obtained using the surface analyzer. The circular marks in FIG. 5, denoting measurement results, are joined by an approximate line (dashed line). The horizontal axis in FIG. 5 is photon energy (eV), and the vertical axis is Emission Yield (cps 0.5) (0.5th power of photoelectron yield per unit photon). A certain slope of Emission Yield/photon energy is obtained on the basis of FIG. 5. The work function in the case of FIG. 5 is represented by the excitation energy (eV) at the inflection point (B) of the dashed line. The work function in FIG. 5 is 5.33 (eV).

Cleaning Evaluation

Cleaning evaluation was performed by detecting streak-like image defects, on the recording material P, and that derive from toner that slips by the cleaning member 8.

In the present evaluation, toner is firstly filled into a developing unit 20 of the process cartridge B. The process cartridge B is allowed to stand for 24 hours in an environment at 23° C. and 50% RH, after which an image having an image ratio of 4% and having a plurality of horizontal lines (lines along the axial direction of the photosensitive drum 1) is printed continuously in 200 prints of a recording material P of A4 size. The presence or absence of streak-like image defects was checked for all of printed 200 prints of recording material P. The results of the present evaluation are given in Table 1. The evaluation criteria in the cleaning evaluation are as follows.

1: No streak-like image defects in any of the 200 prints of recording material P.

2: Streak-like image defects occur in 1 to fewer than 10 prints of recording material P.

3: Streak-like image defects occur in 10 to fewer than 50 prints of recording material P.

4: Streak-like image defects occur in 50 or more prints of recording material P.

Table 1 sets out the measurement results of the work functions of the recovery sheet member 14 and of the toner, of contact pressure of the recovery sheet member 14, as well as results of a cleaning evaluation, in Embodiments 1 to 4 and Comparative examples 1 to 5.

TABLE 1

| | Material of sheet member | Toner | Particle diameter of external additive/nm | Work function of sheet member/eV | Work function of toner/eV | Work function difference/eV | Contact pressure of sheet member | Evaluation |
|---|---|---|---|---|---|---|---|---|
| Embodiment 1 | PPS | A | 50 | 5.80 | 6.03 | 0.23 | 8.72.E−04 | 2 |
| Comparative Example 1 | PPS | A | 20 | 5.80 | 6.03 | 0.23 | 8.72.E−04 | 4 |
| Comparative Example 2 | PPS | A | 30 | 5.80 | 6.03 | 0.23 | 8.72.E−04 | 4 |
| Comparative Example 3 | PET | B | 50 | 5.33 | 5.65 | 0.32 | 5.20.E−04 | 3 |
| Comparative Example 4 | PET | A | 50 | 5.33 | 6.03 | 0.70 | 5.20.E−04 | 4 |
| Comparative Example 5 | PPS | B | 50 | 5.80 | 5.65 | −0.15 | 8.72.E−04 | 3 |
| Embodiment 2 | PTFE | A | 50 | 6.00 | 6.03 | 0.03 | 4.02.E−04 | 1 |
| Embodiment 3 | PPS | A | 50 | 5.80 | 6.03 | 0.23 | 1.57.E−03 | 1 |
| Embodiment 4 | PPS | A | 50 | 5.80 | 6.03 | 0.23 | 1.99.E−03 | 1 |

Comparison Between Embodiments and Comparative Examples

The superiority of the present invention is assessed on the basis of a comparison between examples and comparative examples. The superiority of the present invention with respect to Comparative example 1 will be explained first. As a result of diligent research, the inventors found that strong negative charging of residual toner by the recovery sheet member 14 can be efficiently suppressed through addition, to the toner, of silicon oxide particles having a number average particle diameter equal to or greater than 50 nm. Herein the term strong negative charging of residual toner denotes excessive charging of the residual toner.

The above mechanism will be explained on the basis of a comparison between Embodiment 1 and Comparative examples 1 and 2. In Embodiment 1, silicon oxide particles having a number average particle diameter of 50 nm are externally added to toner A. Comparative example 1 differs from Embodiment 1 in that now silicon oxide particles having a number average particle diameter of 20 nm are externally added to toner A. Comparative example 2 differs from Embodiment 1 in that herein silicon oxide particles having a number average particle diameter of 30 nm are externally added to toner A. The same toner A is used in Embodiment 1, and Comparative examples 1 and 2, and the same PPS is used as the material of the recovery sheet member 14. The work function of toner A is 6.03 eV and the work function of the recovery sheet member 14 is 5.80 eV; accordingly the value of the work function difference between toner A and the recovery sheet member 14 is equally 0.23 eV in Embodiment 1 and in Comparative examples 1 and 2. In the cleaning evaluation in Embodiment 1, streak-like image defects occur in one to fewer than 10 prints of the recording material P, whereas in the cleaning evaluation of Comparative examples 1 and 2, streak-like image defects occur in 50 or more prints of the recording material P. This derives from the influence that the magnitude of the number average particle diameter of the silicon oxide particles, which are the external additive, exert on the effect of suppressing strong negative charging. The number average particle diameter of the silicon oxide particles in Comparative example 1 is 20 nm. In Comparative example 1, toner particles agglomerate readily with each other since the number average particle diameter of the silicon oxide particles in Comparative example 1 is smaller than the number average particle diameter of the silicon oxide particles in Embodiment 1. In Comparative example 1, therefore, opportunities for rubbing with the recovery sheet member 14 arise only in part of the toner surface, and thus the effect of suppressing strong negative charging is insufficient. In Comparative example 2, the number average particle diameter of the silicon oxide particles is 30 nm, and the effect of suppressing strong negative charging is insufficient, as in Comparative example 1. In Embodiment 1, by contrast, agglomeration of toner particles is suppressed, and gaps appear readily between toner particles, by virtue of the fact that the number average particle diameter of the silicon oxide particles is 50 nm. Accordingly, the toner rolls readily at the contact region between the recovery sheet member 14 and the photosensitive drum 1, and the chances of rubbing of the toner surface and the recovery sheet member 14 increase. By virtue of the fact that the number average particle diameter of the silicon oxide particles is 50 nm in Embodiment 1, therefore, the effect of suppressing strong negative charging of residual toner is brought out efficiently, and in consequence the occurrence of streak-like image defects is suppressed.

In Comparative example 3, toner B is used, in which PET is used as the material of the recovery sheet member 14 and silicon oxide particles having a number average particle diameter of 50 nm are externally added. In the cleaning evaluation of Comparative example 3, streak-like image defects occur in 10 to fewer than 50 prints of the recording material P, i.e. numerous streak-like image defects derived from faulty cleaning occur. The foregoing is caused by strong negative charging that arises from rubbing of the toner against the recovery sheet member 14 during passage of residual toner on the photosensitive drum 1 through the contact region between the recovery sheet member 14 and the photosensitive drum 1. Strong electrostatic adhesion forces act between the strongly negative residual toner and the photosensitive drum 1, and as a result it is difficult for the cleaning member 8 to remove the residual toner by scraping the toner from the photosensitive drum 1. As a result, in a case where polymerized toner of high circularity is used, the toner readily slips by the cleaning member 8 and remains then on the photosensitive drum 1, such that vertical streaks are prone to forming thereafter on the image that is transferred to the recording material P during image forming.

In Comparative example 4, toner B of Comparative example 3 is changed to toner A. The external additive in Comparative example 4 is prepared in accordance with the same conditions as in Comparative example 1. In the cleaning evaluation of Comparative example 4, streak-like image defects occur in 50 or more prints of the recording material P, i.e. more streak-like image defects than in the case of Comparative example 3.

Figure 6:
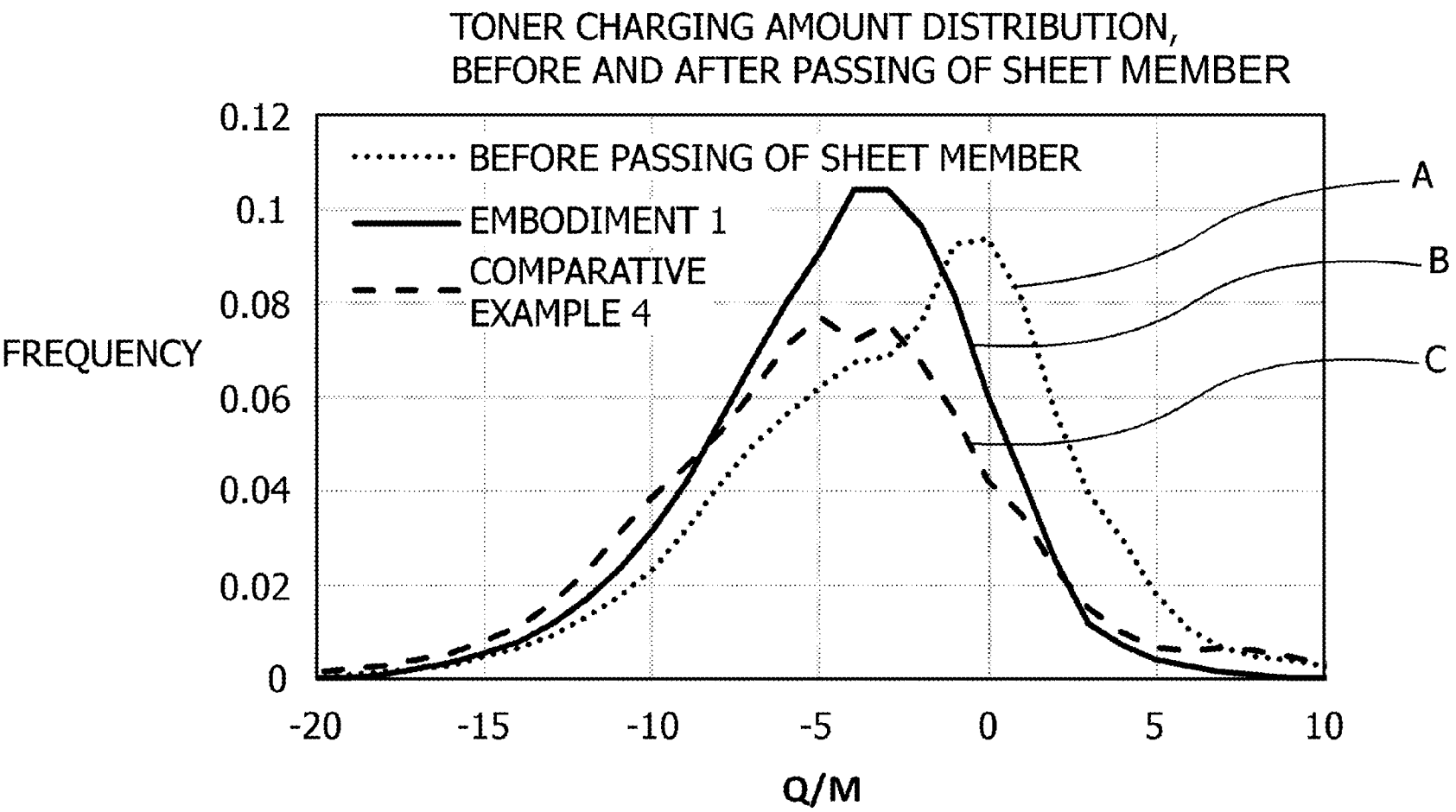
FIG. 6 is a graph representing toner charging amounts in Embodiment 1 and Comparative example 4.

In Embodiment 1, by contrast, PPS is used as the material of the recovery sheet member 14, and silicon oxide particles having a number average particle diameter of 50 nm are externally added to toner A. The cleaning evaluation in Embodiment 1 yields thus fewer streak-like image defects than in Comparative examples 1 to 4. That is because strong negative charging of residual toner, derived from rubbing of the residual toner on the photosensitive drum 1 at the contact region of the recovery sheet member 14 and the photosensitive drum 1, is suppressed in Embodiment 1, and the residual toner can be maintained at an appropriate charging amount. In Embodiment 1, the electrostatic adhesion forces between the photosensitive drum 1 and the residual toner decrease, and the residual toner can be removed easily by the cleaning member 8. FIG. 6 illustrates a comparison of toner charging amount, before and after passing of the recovery sheet member 14, between Comparative example 4 and Embodiment 1. The horizontal axis of FIG. 6 represents a charging amount (Q/M) of one toner, and the vertical axis in FIG. 6 represents a ratio (frequency) with respect to number of measured toners. The dotted line A in FIG. 6 represents toner charging amount prior to passage of the residual toner by the recovery sheet member 14. The solid line B in FIG. 6 represents toner charging amount after passage of the residual toner by the recovery sheet member 14, under the conditions of Embodiment 1. The dotted line C in FIG. 6 represents the toner charging amount after passage of the residual toner by the recovery sheet member 14, under the conditions of Comparative example 4. As FIG. 6 shows, in Comparative example 4, the toner charging amount increases significantly after passage of the residual toner by the recovery sheet member 14, whereas in Embodiment 1, the increase in toner charging amount after passage of the residual toner by the recovery sheet member 14 is minor.

An explanation follows next on the surmised mechanism underlying the difference in the increase of the charging amount in residual toner between Embodiment 1 and Comparative examples 3 and 4.

As a result of diligent research, the inventors found that a difference (work function difference) between the work function of the toner and the work function of the recovery sheet member 14 influences the charging amount increment of residual toner. Upon rubbing of resin materials having different work functions, negative charge moves from the material of smaller work function towards the material of greater work function. As a result, the material of smaller work function becomes charged positively and the material of greater work function becomes charged negatively.

As Table 1 indicates, the work function difference in Comparative example 3 ((work function of toner)-(work function of recovery sheet member 14)) is 0.32 eV. The work function difference in Comparative example 4 is 0.7 eV. In Comparative example 3 and Comparative example 4 strong negative charging of residual toner occurs on account of the combinations of recovery sheet member 14 and toner that exhibit herein a large work function differences. The work function difference between the recovery sheet member 14 and the toner in Comparative example 4 is larger than the work function difference between the recovery sheet member 14 and the toner in Comparative example 3, and accordingly more streak-like image defects occur in Comparative example 4 than in Comparative example 3. In Embodiment 1, by contrast, the combination of recovery sheet member 14 and toner is PPS and toner A, and the work function difference takes on a small value of 0.23 eV; in consequence, strong negative charging of residual toner is suppressed. Therefore, the cleaning evaluation in Embodiment 1 reveals that streak-like image defects are suppressed.

Embodiment 2 will be explained next. In Embodiment 2, PTFE is used as the material of the recovery sheet member 14, and silicon oxide particles having a number average particle diameter of 20 nm are externally added to toner A. The work function difference in Embodiment 2 is very small, of 0.03 eV, and the cleaning evaluation reveals no occurrence of streak-like image defects in the recording material P.

Comparative example 5 will be explained next. In Comparative example 5, PPS is used as the material of the recovery sheet member 14, and silicon oxide particles having a number average particle diameter of 50 nm are externally added to toner B. In the cleaning evaluation of Comparative example 5, streak-like image defects occur in 10 to fewer than 50 prints of the recording material P, i.e. numerous streak-like image defects derived from faulty cleaning. This is because the work function difference in Comparative example 5 takes on a negative value. Unlike in Embodiments 1 and 2 and Comparative examples 1 to 4, the value of the work function of the recovery sheet member 14 in Comparative example 5 is larger than the value of the work function of toner, and accordingly the recovery sheet member 14 tends to be charged negatively, and toner to be charged positively. The residual toner that rubs against the recovery sheet member 14 has a smaller charging amount than prior to rubbing, and the electrostatic adhesion forces between the photosensitive drum 1 and the residual toner are excessively small, as a result of which residual toner moves off the photosensitive drum 1 and adheres readily to the recovery sheet member 14, without passing by the recovery sheet member 14. In consequence, toner adheres to the recovery sheet member 14 and pools up in the contact region between the recovery sheet member 14 and the photosensitive drum 1, and accordingly there are fewer rubbing opportunities between the residual toner on the photosensitive drum 1 and the recovery sheet member 14, and the effect of suppressing strong negative charging of residual toner is impaired. From all the above it follows that it is preferable to suppress strong negative charging of residual toner, and also to charge residual toner with a weak charging amount. However, it is undesirable to bring the charging amount of the residual toner down to a value close to 0. As a condition for achieving the foregoing, the work function difference between the toner and the recovery sheet member 14 is preferably set to be equal to or greater than 0 eV and equal to or smaller than 0.23 eV.

The present invention allows suppressing strong negative charging of residual toner by relying on a combination such that the value of the work function difference between the toner and the recovery sheet member 14 (work function of the toner—work function of the recovery sheet member 14) is equal to or greater than 0 eV and equal to or smaller than 0.23 eV. The effect of suppressing strong negative charging of residual toner can be efficiently brought out through the use of toner having externally added thereto silicon oxide particles having a number average particle diameter of 50 nm or larger. As a result, it becomes possible to easily remove residual toner by means of the cleaning member 8, and to suppress the occurrence streak-like image defects in the recording material P.

Embodiment 3 and Embodiment 4, which elicit an effect more pronounced than Embodiment 1, will be explained next.

In Embodiment 3, the result of the cleaning evaluation is better than in Embodiment 1, and no streak-like image defects occur in the recording material P. That is because the recovery sheet member 14 is bonded to the frame 15 using a double-sided tape, and accordingly the contact pressure of the recovery sheet member 14 on the photosensitive drum 1 is proportionally increased by 1 mm, which is the thickness of the double-sided tape. Through an increase in the contact pressure of the recovery sheet member 14 on the photosensitive drum 1, a layer of residual toner at the contact nip between the recovery sheet member 14 and the photosensitive drum 1 is made uniform, and the rubbing opportunities of the residual toner and the recovery sheet member 14 increase. The effect of suppressing strong negative charging of residual toner is further promoted as a result.

Figure 7:
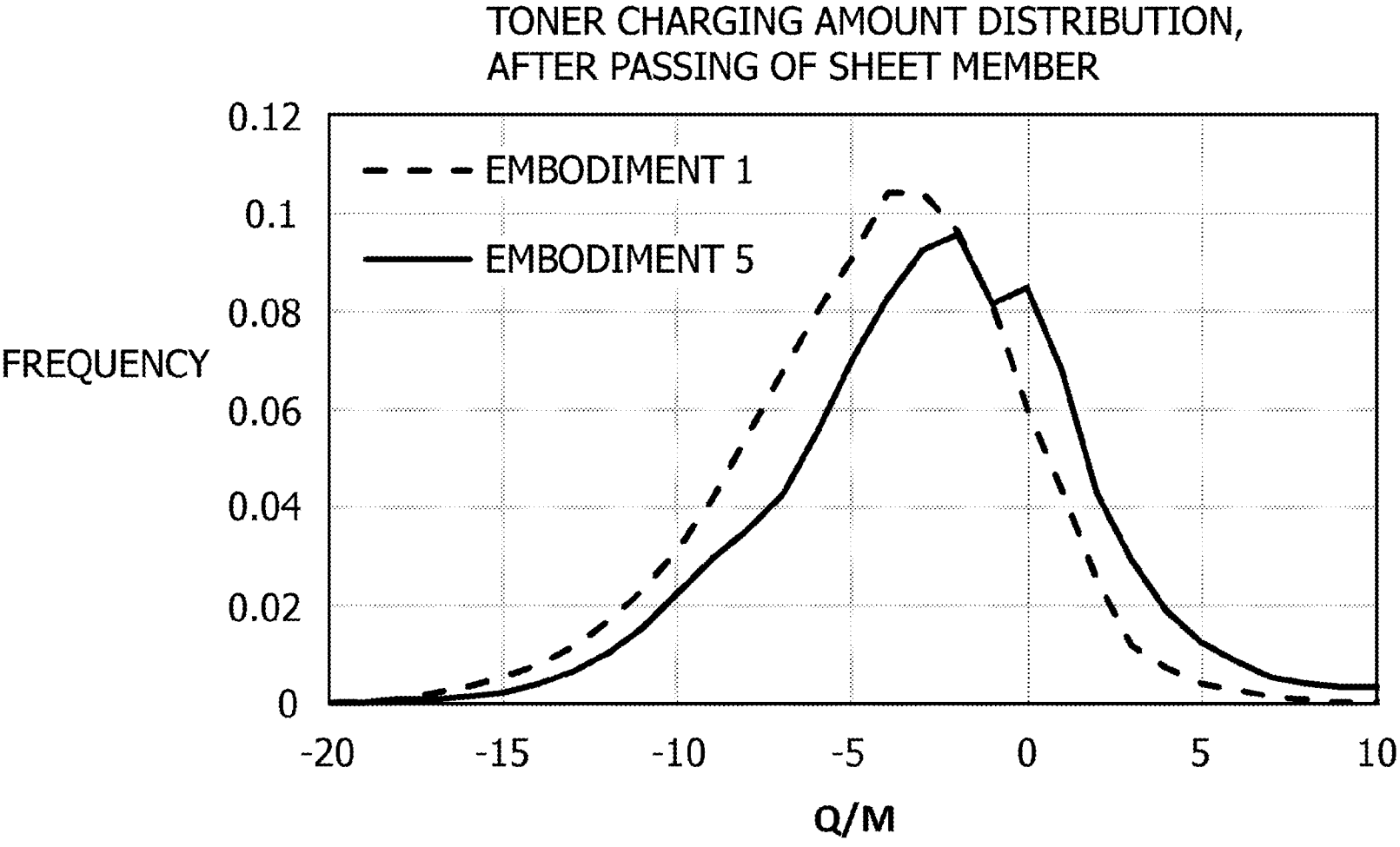
FIG. 7 is a graph representing toner charging amounts in Embodiment 1 and Embodiment 4.

In Embodiment 4 as well, the result of the cleaning evaluation is better than in Embodiment 1, and no streak-like image defects occur in the recording material P. That is because the contact pressure on the photosensitive drum 1 is increased given that the thickness of the recovery sheet member 14 is herein 50 μm. Through setting of the thickness of the recovery sheet member 14 to 50 μm, the waviness (undulation) of the recovery sheet member 14 at the time of affixing the recovery sheet member 14 to a seat surface of the frame 15 is reduced, and it becomes possible to generate a significant contact pressure against the photosensitive drum 1, uniformly over the length thereof. The thickness of the recovery sheet member 14 may be set to be at least 50 μm and not more than 100 μm. That is because using an excessively thick recovery sheet member 14 may result in adverse effects such as damage to the photosensitive drum 1. FIG. 7 illustrates a toner charging amount distribution after passage of the residual toner by the recovery sheet member 14 in Embodiments 1 and 4. As illustrated in FIG. 7, in Embodiment 4 the effect of suppressing strong negative charging of residual toner is promoted through an increase in the contact pressure of the recovery sheet member 14 against the photosensitive drum 1, similarly to Embodiment 3.

From the above it follows that, preferably, a work function W (D) of the toner (developer) and a work function W (S) of the recovery sheet member 14 satisfies Relational expression (A) below, the toner has inorganic fine particles, and the average primary particle diameter of at least one particle type from among the inorganic fine particles is 50 nm or larger. As a result, it becomes possible to suppress strong negative charging of residual toner, and to prevent excessively charged residual toner from reaching the cleaning member 8. The occurrence of image defects on the recording material P, derived from faulty cleaning, can be suppressed as a result.

$$0 \leq W(D) - W(S) \leq 0.23 \quad \text{(A)}$$

The term average primary particle diameter denotes the number average particle diameter of primary particles. The average primary particle diameter of at least one particle type from among the inorganic fine particles is 50 nm or larger. Although from the viewpoint of "strong negative charging of residual toner suppression" an upper limit of the average primary particle diameter need not be particularly prescribed, the upper limit is however preferably set to 200 nm or less. That is because excessively large particles may result in lower adhesion to toner.

The present invention is not limited to the features in the above examples. In the examples, one type of material as the recovery sheet member 14 is used, but instead of PPS there may be used for instance a two-layer material having a base material formed of a PET sheet, with a PPS sheet overlaid then thereon. In terms of the material on the surface of the recovery sheet member 14 that is in contact with the photosensitive drum 1, the effect of the present invention is elicited by virtue of the fact that the work function difference (W(D)−W(S)) between the toner and the recovery sheet member 14 satisfies Relational expression (A).

In the above examples, toner A having a styrenic resin is used as a binder resin and an ester compound as a release agent, with a crystalline polyester finely dispersed in the toner. The present invention is however not limited to this toner A. Also in the case of toners that utilize other materials, the effect of the present invention is brought out by virtue of the fact that the work function difference between the toner and the recovery sheet member 14 satisfies Relational expression (A).

The present invention can be used in image forming apparatuses such as copiers and printers, as well as in process cartridges that are used in such image forming apparatuses.

An explanation follows next on Comparative examples 6 to 9 for verifying the effect of Embodiment 1, and on Embodiments 6 to 8 which exhibit a more pronounced effect of the present invention than Embodiment 5 of the present invention. The features in Comparative examples 6 to 9 and Embodiments 5 to 8 are substantially identical to those of Embodiment 1, except for the points particularly explained below. In Comparative examples 6 to 9 and Embodiments 5 to 8, functions and constituent elements corresponding to Embodiment 1 will be denoted by identical reference symbols.

Comparative Example 6

Comparative example 6 differs from Embodiment 1 in that a bias power source (high voltage power source) applied to the charging roller is modified to DC voltage. In Comparative example 6, DC voltage of −900 V is applied to the charging roller, to thereby charge the photosensitive drum surface to −400 V, similarly to Embodiment 1.

Comparative Example 7

Comparative example 7 differs from Embodiment 1 in that herein the material of the recovery sheet member 14 and the material of the toner base are modified. The materials used as the materials of the recovery sheet member and the toner of Comparative example 7 are as follows.

Recovery Sheet Member

Material (Base Material): PET sheet (by Toray Industries, Inc.: Lumirror (registered trademark))

Thickness: 38 (μm)

Work function: 5.33 (eV)

Flexural elasticity modulus: 2000 ($N/m^2$)

Poisson's ratio: 0.21

The contact conditions of the recovery sheet member 14 with the photosensitive drum 1 are given below. The recovery sheet member 14 is joined to the cleaning frame 15 by laser welding.

Penetration amount: 3.4 (μm)

Setting angle: 28.6 (°)

Deflection amount δ: 1.24 (mm)

Contact pressure: $5.20\times10^{-4}$ (N/mm)

Toner

The binder resin of the magnetic toner of Comparative example 7 is a styrenic resin, and the release agent is an ester compound. Comparative example 7 differs from Embodiment 1 in that no crystalline polyester is added. The work functions between Comparative example 7 and Embodiment 1 differ since the materials used in the respective toner bases are different from each other. The work function of the toner of Comparative example 7 is 5.65 eV.

Comparative Example 8

Comparative example 8 differs from Embodiment 1 in that herein the material of the recovery sheet member 14 is modified.

Recovery Sheet Member

Material (Base Material): PET sheet (by Toray Industries, Inc.: Lumirror (registered trademark))

Thickness: 38 (μm)

Work function: 5.33 (eV)

Flexural elasticity modulus: 2000 ($N/m^2$)

Poisson's ratio: 0.21

The contact conditions of the recovery sheet member 14 with the photosensitive drum 1 are given below. The recovery sheet member 14 is joined to the cleaning frame by laser welding.

Penetration amount: 3.4 (μm)

Setting angle: 28.6 (°)

Deflection amount δ: 1.24 (mm)

Contact pressure: $5.20\times10^{-4}$ (N/mm)

Comparative Example 9

Comparative example 9 differs from Embodiment 1 in that the conditions of the toner base are modified to conditions identical to those of Comparative example 7.

Embodiment 5

Embodiment 5 differs from Embodiment 1 in that herein the material of the recovery sheet member 14 is modified.

Recovery Sheet Member

Material (Base Material): PTFE (polytetrafluoroethylene) sheet (Teflon (registered trademark))

Thickness: 50 (μm)

Work function: 6.0 (eV)

Flexural elasticity modulus: 560 ($N/m^2$)

Poisson's ratio: 0.46

The contact conditions of the recovery sheet member 14 with the photosensitive drum 1 are given below. The recovery sheet member 14 is joined to the cleaning frame by laser welding.

Penetration amount: 3.4 (μm)

Setting angle: 28.6 (°)

Deflection amount δ: 1.24 (mm)

Contact pressure: $4.02\times10^{-4}$ (N/mm)

Embodiment 6

Embodiment 6 differs from Embodiment 1 in the method for affixing the recovery sheet member 14 to the recovery container 9. In Embodiment 6, a double-sided tape is spread on the cleaning frame, and then a recovery sheet member is laid on the double-sided tape, to thereby fix the recovery sheet to the cleaning frame. The contact conditions of the recovery sheet member 14 with the photosensitive drum 1 are given below.

Penetration amount: 4.9 (μm)

Setting angle: 37.3 (°)

Deflection amount δ: 2.24 (mm)

Contact pressure: $1.57\times10^{-3}$ (N/mm)

Embodiment 7

Embodiment 7 differs from Embodiment 1 in that the thickness of the recovery sheet member is modified. In Embodiment 7, a PPS sheet having a thickness of 60 μm is bonded, by laser welding, to a cleaning frame, so that the contact conditions of the recovery sheet member 14 with the photosensitive drum 1 are as follows.

Penetration amount: 3.4 (μm)

Setting angle: 28.7 (°)

Deflection amount δ: 1.24 (mm)
Contact pressure: $1.99\times10^{-3}$ (N/mm)

Embodiment 8

Embodiment 8 differs from Embodiment 1 in that herein the peak-to-peak voltage value Vpp during non-image forming is set to 1700 V, greater than that during image forming.

Combinations of Recovery Sheet Member and Toner

Combinations of an AC charging scheme, a recovery sheet member and toner, which are the point of the present invention, will be explained next. The inventors found that the magnitude relation between the work functions (the measuring method thereof will be explained in detail further on) of the recovery sheet member 14 and the toner affects significantly the cleaning performance of the toner remaining on the photosensitive drum. The inventors found also that good cleaning performance can be maintained over long periods of time by resorting to an AC charging scheme. An evaluation method and evaluation results are explained in detail next.

Evaluation Method in Embodiments and Comparative Examples

Work Function Measurement

Focusing on the positional relationship of the recovery sheet member 14 and toner in a triboelectric series, in the present invention three types of recovery sheet member 14 and two types of toner (A and B) used in experiments were evaluated on the basis of respective work functions measured in accordance with the below-described measuring method.

The work function (Φ) of a substance is the energy required to extract electrons from the substance. In a case where a difference in the work functions of two members is large, the electric field generated by triboelectric charging between the two members is large, while in a case where the difference in the work functions of the two members is small, the electric field generated by triboelectric charging between the two members is likewise small.

Method for Measuring Work Function

The work function can be measured in accordance with the measuring method below. The work function, which is quantified as the energy (eV) for extracting electrons from a substance, allows evaluating the charging polarity of the recovery sheet member 14 and of the toner.

The work function (Φ) is measured herein using a surface analyzer (AC-2, by Riken Keiki Co., Ltd.). In the surface analyzer a deuterium lamp is used, an irradiation light amount is set as appropriate, and monochromatic light is selected by a spectrometer and is projected onto a sample, to a spot size of 4 (mm)×4 (mm), over an energy operation range of 3.4 to 6.2 (eV), and for a measurement time of 10 (sec/l point). Photoelectrons emitted from the sample surface are detected and are computed by a work function meter software built into the surface analyzer, to thereby measure the work function. The work function is measured with a repeatability (standard deviation) of 0.02 (eV). The work functions of the recovery sheet member 14 and of the toner are measured in a state prior to image formation. The measurement is performed after removal, by air blowing, of dirt on the surface of the recovery sheet member 14. In order to ensure data reproducibility, after image forming the recovery sheet member 14 is allowed to stand for 24 hours under conditions of use temperature of 25° C. and humidity 55% RH, to yield a measurement sample. To measure a sheet-shaped sample, such as the recovery sheet member 14, measurement light is projected to a 4 (mm)×4 (mm) spot; hence, the sample piece as a sample is cut to a size of at least 1 (cm)×1 (cm), and the resulting test piece is fitted to a sample stand, whereupon the measurement is carried out.

In the case of measurement of a powdery sample such as toner, the toner is laid smoothly, without gaps, on a shallow dish-like container having a size of at least 1 (cm)×1 (cm), and the container is fixed to a sample stand, to perform the measurement.

Upon scanning from low to high excitation energy of the monochromatic light in the surface analyzer, emission of photons starts from a predetermined energy value (eV). This predetermined energy value is taken as the work function (eV). FIG. 5 illustrates an example of a graph of the work function of the recovery sheet member 14, obtained using the surface analyzer. The circular marks in FIG. 5, denoting measurement results, are joined by an approximate line (dashed line). The horizontal axis in FIG. 5 is photon energy (eV), and the vertical axis is Emission Yield (cps 0.5) (0.5th power of photoelectron yield per unit photon). A certain slope of Emission Yield/photon energy is obtained on the basis of FIG. 5. The work function in the case of FIG. 5 is represented by the excitation energy (eV) at the inflection point (B) of the dashed line. The work function in FIG. 5 is 5.33 (eV).

Cleaning Evaluation

Cleaning evaluation was performed by detecting streak-like image defects, on the recording material P, that derive from toner slipping by the cleaning member 8.

Cleaning Evaluation (Initial)

In the present evaluation, toner is firstly filled into a developing unit 20 of the process cartridge B. The process cartridge B is allowed to stand for 24 hours in an environment at 7.5° C. and 30% RH, after which an image having an image ratio of 4% and having a plurality of horizontal lines (lines along the axial direction of the photosensitive member drum) is printed continuously in 200 prints of a recording material P of A4 size. The presence or absence of streak-like image defects was checked for all of printed 200 prints of recording material P.

Cleaning Evaluation (After Durability Test)

The present evaluation was performed after the above (initial) cleaning evaluation. An image having an image ratio of 4% and having a plurality of horizontal lines (lines along the axial direction of the photosensitive member drum) is printed intermittently in 10000 prints of a recording material P of A4 size. The term intermittent denotes herein a printing method in which a predetermined number of prints of the recording material P are printed, the printing operation is temporarily discontinued thereafter, and then a printing operation is performed once more. After the 10000 prints, an image having an image ratio of 4% and having a plurality of horizontal lines was printed continuously in 200 prints of a recording material P of A4 size, and the presence or absence of streak-like image defects was checked for all of printed 200 prints of recording material P. The results of the present evaluation are given in Table 2.

The evaluation criteria of the cleaning evaluation are as follows.

1: No streak-like image defects in any of the 200 prints of recording material P.

2: Streak-like image defects occur in 1 to fewer than 10 prints of recording material P.

3: Streak-like image defects occur in 10 to fewer than 50 prints of recording material P.

4: Streak-like image defects occur in 50 or more prints of recording material P.

Table 2 sets out the measurement results of the work functions of the recovery sheet member 14 and of the toner, of contact pressure of the recovery sheet member 14, as well as results of a cleaning evaluation, in Embodiments 1 and 5 to 8, and Comparative examples 6 to 9.

TABLE 2

| | Material of sheet member | Toner | Charging scheme | Work function of sheet member/eV | Work function of toner/eV | Work function difference eV | Contact pressure of sheet member | Evaluation (initial) | Evaluation (after durability test) |
|---|---|---|---|---|---|---|---|---|---|
| Embodiment 1 | PPS | A | AC | 5.80 | 6.03 | 0.23 | 8.72.E−04 | 2 | 2 |
| Comparative Example 6 | PPS | A | DC | 5.80 | 6.03 | 0.23 | 8.72.E−04 | 2 | 4 |
| Comparative Example 7 | PET | B | AC | 5.33 | 5.65 | 0.32 | 5.20.E−04 | 3 | 3 |
| Comparative Example 8 | PET | A | AC | 5.33 | 6.03 | 0.70 | 5.20.E−04 | 4 | 4 |
| Comparative Example 9 | PPS | B | AC | 5.80 | 5.65 | −0.15 | 8.72.E−04 | 3 | 3 |
| Embodiment 5 | PTFE | A | AC | 6.00 | 6.03 | 0.03 | 4.02.E−04 | 1 | 1 |
| Embodiment 6 | PPS | A | AC | 5.80 | 6.03 | 0.23 | 1.57.E−03 | 1 | 1 |
| Embodiment 7 | PPS | A | AC | 5.80 | 6.03 | 0.23 | 1.99.E−03 | 1 | 1 |

Superiority of Present Invention with Respect to Comparative Examples

The superiority of the present invention is assessed on the basis of a comparison between examples and comparative examples.

The superiority of the present invention with respect to Comparative example 6 will be explained first. As a result of diligent research, the inventors found that suppression of strong negative charging of residual toner by the recovery sheet member 14 can be maintained, over a long period of use, by relying on an AC charging scheme in which AC voltage is applied to the charging roller 2. Herein the term strong negative charging of residual toner denotes excessive charging of the residual toner.

The above mechanism will be explained on the basis of a comparison between Embodiment 1 and Comparative example 6. In Embodiment 1, AC voltage and DC voltage are applied (AC charging scheme), superimposed on each other, to the charging roller 2. Comparative example 6 differs from Embodiment 1 in that herein only DC voltage is applied to the charging roller 2. The same toner A is used in Embodiment 1 and Comparative example 6, and the same PPS is used as the material of the recovery sheet member 14. The value of the work function difference is equally 0.23 eV in Embodiment 1 and Comparative example 6. The results of the cleaning evaluation reveal that in Embodiment 1 the occurrence of vertical streak images is initially minor, and this minor level is maintained until after a durability test. In Comparative example 6, by contrast, vertical streak images occur at a minor level initially, but poor-level vertical streak images occur after the durability test. This derives conceivably from the influence of the charging scheme on the effect of suppressing strong negative charging. It is deemed that toner or external additive pools up, as a result of long-term printing, in the contact region between the recovery sheet member 14 and the photosensitive drum 1. An observation of the process cartridge B in Comparative example 6 after evaluation showed that actually the toner and external additive is adhered to the surface of the recovery sheet member 14. All the above suggests that in Comparative example 6 toner and external additive adhere to the surface of the recovery sheet member 14 as a result of long-term printing, and in consequence the effect of suppressing strong negative charging of residual toner by the recovery sheet member 14, after the durability test, is weak, and in the cleaning evaluation vertical streak images occur, with a poor evaluation level.

The reasons for the fact that in Embodiment 1 vertical streak images are kept at a minor level, also after the durability test, are explained next.

Figure 8:
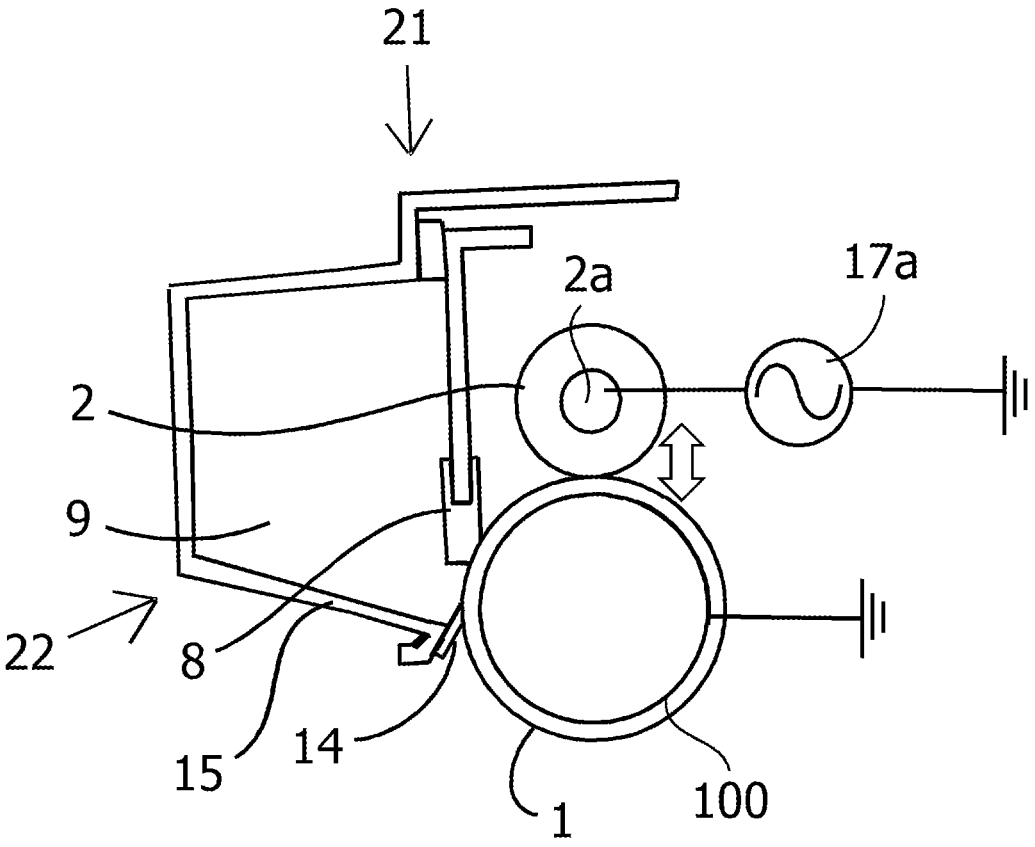
FIG. 8 is a schematic cross-sectional diagram of a photosensitive drum unit.

FIG. 8 illustrates a schematic diagram of the charging roller 2 and the photosensitive drum 1 in the image forming apparatus of Embodiment 1. Embodiment 1 is an AC charging scheme. Accordingly, an AC electric field by AC voltage is generated within the image forming apparatus, between a shaft 2*a* of the charging roller 2 connected to an AC voltage power supply 17*a* included in the power supply unit as a voltage application means, and a metal base pipe 100 of the photosensitive drum 1 connected to ground. On account of the AC electric field, electrostatic attraction acts between the charging roller 2 and the photosensitive drum 1, with a force that varies with the period of the AC electric field. The charging roller 2, which is formed of an elastic body, vibrates slightly on account of this varying electrostatic attraction. The charging roller 2 is kept in contact with the photosensitive drum 1 by spring pressure (not shown), and accordingly the vibration of the charging roller 2 is transmitted to the photosensitive drum 1, which likewise vibrates thus slightly. That is, the photosensitive drum 1 vibrates slightly in Embodiment 1, which is an AC charging scheme. It is deemed that, as a result, the toner rolls readily in the contact region between the photosensitive drum 1 and the recovery sheet member 14, and retention of toner is suppressed.

Upon observation of the surface of the recovery sheet member after evaluation, in Embodiment 1 and Comparative example 6, it is found that actually a greater amount of toner and external additive adhered to the surface of the recovery sheet 14 in Comparative example 6 than in Embodiment 1. This reveals that continued adhesion of toner and external additive to the surface of the recovery sheet member 14 in Embodiment 1 can be suppressed, and that weakening of the suppression effect of strong negative charging of residual toner by the recovery sheet member 14 can be prevented. As a result, it becomes possible to maintain an image level similar to that of the initial one, even after the durability test. The vibration of the photosensitive drum 1 is slight herein, and the cleaning member 8 is in contact with the photosensitive drum 1 at a sufficiently high contact pressure; hence, voids are not generated on account of vibration of the photosensitive drum 1 at the contact region between the cleaning member 8 and the photosensitive drum. In consequence, vibration of the photosensitive drum 1 derived from the AC charging scheme allows prompting rolling of the toner at the contact region between the recovery sheet member 14 and the photosensitive drum 1, without slipping of the toner at the contact region between the cleaning member 8 and the photosensitive drum 1.

An explanation follows next on combinations of the recovery sheet member 14 and toner, and which are the point of the present invention. The inventors found that the magnitude relation between the work functions (the measuring method thereof will be explained in detail further on) of the recovery sheet member and the toner affects significantly the cleaning performance of the toner remaining on the photosensitive drum. The above mechanism will be explained on the basis of a comparison between Embodiments 1 and 2, and Comparative examples 7 and 8.

Comparative example 7 is an example in which PET is used as the material of the recovery sheet member 14, and toner B is used as the toner. The cleaning evaluation in Comparative example 7 reveals significant occurrence of vertical streak images derived from faulty cleaning. The foregoing is caused by strong negative charging that arises from rubbing of the toner against the recovery sheet member 14 during passage of residual toner on the photosensitive drum 1 through the contact region between the recovery sheet member 14 and the photosensitive drum. Strong electrostatic adhesion forces act between the strongly negative residual toner and the photosensitive drum 1, and in consequence it is difficult for the cleaning member 8 to remove the residual toner by scraping the toner from the photosensitive drum 1. As a result, and particularly in the present example where polymerized toner of high circularity is used, the toner readily slips by the cleaning member 8 and remains then on the photosensitive drum 1, so that vertical streaks occur thereafter on the image that is transferred to recording paper during image forming.

In Comparative example 8, the toner of Comparative example 7 is changed to toner A. The result of the cleaning evaluation reveals greater occurrence of vertical streak images than in Comparative example 7.

Figure 9:
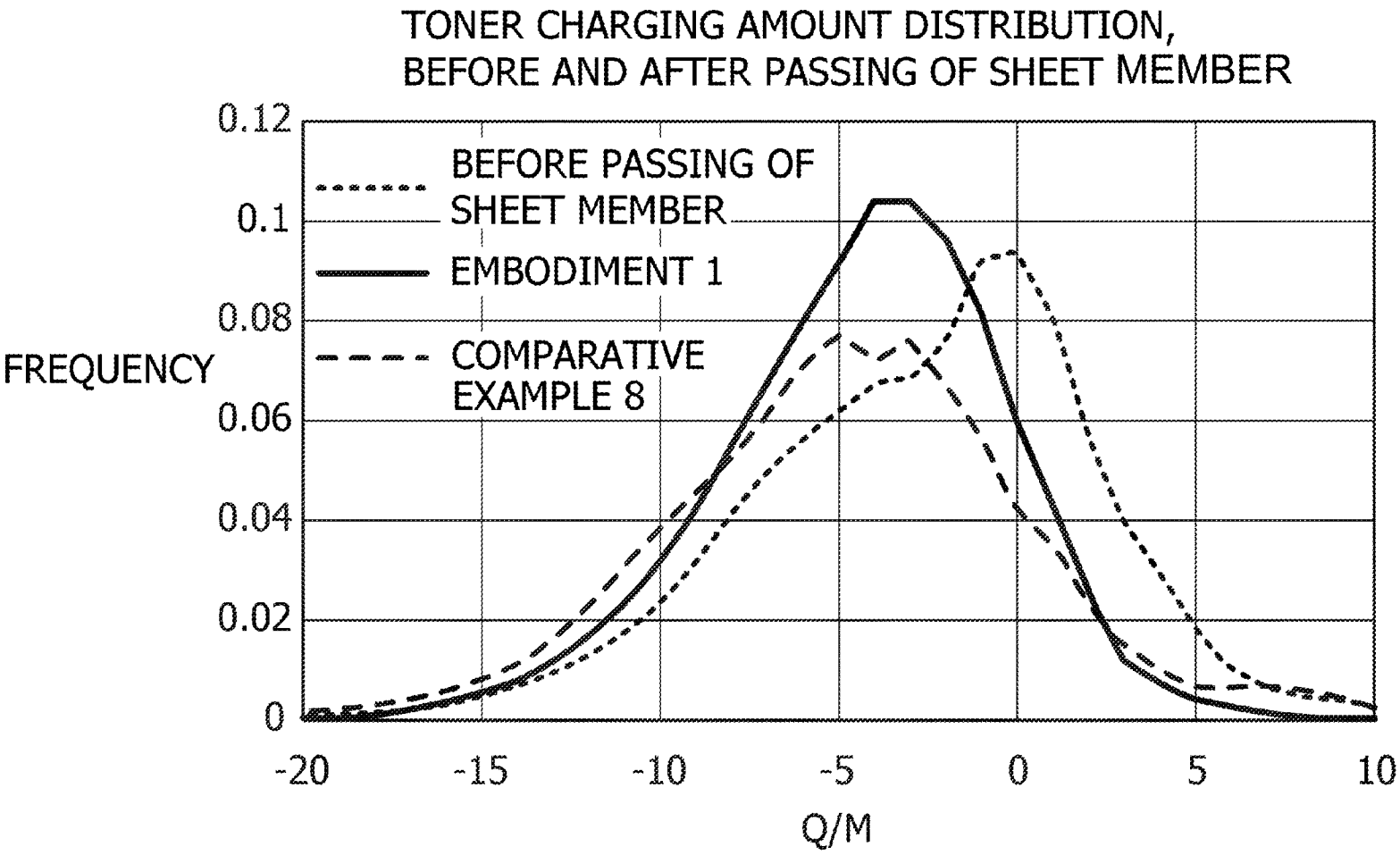
FIG. 9 is a graph representing toner charging amounts in Embodiment 1 and Comparative example 9.

In Embodiment 1, the material of the recovery sheet member 14 is PPS and toner A is utilized. The result of the cleaning evaluation in Embodiment 1 reveals no occurrence of vertical streak images. That is because strong negative charging of residual toner, derived from rubbing of the residual toner on the photosensitive drum 1 at the contact region of the recovery sheet member 14 and the photosensitive drum 1, is suppressed, and the residual toner can be maintained at an appropriate charging amount. It is deemed that the underlying reason for this is that electrostatic adhesion forces between the photosensitive drum 1 and the residual toner decrease, and the residual toner can be removed easily by the cleaning member 8. FIG. 9 illustrates a comparison of toner charging amount, before and after passing of the recovery sheet, between Comparative example 8 and Embodiment 1. FIG. 9 shows that in Comparative example 8, the toner charging amount increases significantly after passage of the residual toner by the recovery sheet member 14, whereas in Embodiment 1, the increase in toner charging amount after passage of the residual toner by the recovery sheet member 14 is minor.

An explanation follows next on the surmised mechanism underlying the difference in the increase of the charging amount in residual toner by the recovery sheet member between Embodiment 1 and Comparative examples 7 and 8.

As a result of diligent research, the inventors found that a difference (work function difference) between the work function of the toner and the work function of the recovery sheet member 14 influences the charging amount increment of residual toner that passes by the recovery sheet member 14. Upon rubbing of resin materials having different work functions, negative charge moves from the material of smaller work function towards the material of greater work function. As a result, the material of smaller work function becomes charged positively and the material of greater work function becomes charged negatively.

As Table 2 indicates the work function difference in Comparative example 7 ((work function of toner)-(work function of recovery sheet member)) is 0.32 eV. The work function difference in Comparative example 8 is 0.7 eV. It is deemed that in Comparative example 7 and Comparative example 8 strong negative charging of residual toner occurs on account of the combination of recovery sheet member and toner exhibiting a large work function difference. The underlying reason for the greater occurrence of vertical streak images in Comparative example 8 than in Comparative example 7 is deemed to be that combination of recovery sheet member and toner in Comparative example 8 exhibits a larger work function difference than that in Comparative example 7. In Embodiment 1, by contrast, the combination of recovery sheet member 14 and toner is PPS and toner A, and the work function difference takes on a small value of 0.23 eV. It is deemed that, as a result, strong negative charging of residual toner is suppressed and no vertical streak images occur in the cleaning evaluation.

Embodiment 5 is an example in which PTFE is used as the material of the recovery sheet member 14 and toner A is used as the toner. The work function difference takes on a very small value, of 0.03 eV, and no vertical streak images occur in the cleaning evaluation.

Comparative example 9 will be explained next.

Comparative example 9 is an example in which PPS is used as the material of the recovery sheet member 14, and toner B is used as the toner. The cleaning evaluation reveals significant occurrence of vertical streak images. This is deemed to arise from the fact that the value of the work function difference is negative. Given the differences between Embodiments 1 and 5, and Comparative examples 6 to 8, it is deemed that the recovery sheet tends to be charged negatively and the toner to be charged positively, since the value of the work function of the recovery sheet member 14 is larger than the value of the work function of the toner. The residual toner that rubs against the recovery sheet member 14 has a smaller charging amount than prior to rubbing, and the electrostatic adhesion forces between the photosensitive drum 1 and the residual toner are excessively small; it is considered that, as a result, residual toner moves off the photosensitive drum and adheres readily to the recovery sheet member 14, without passing by the recovery sheet member 14. As a result, toner adheres to the recovery sheet member 14 and pools up in the contact region between the recovery sheet member 14 and the photosensitive drum 1, and accordingly there are fewer rubbing opportunities between the residual toner on the photosensitive drum 1 and the recovery sheet member 14, and the effect of suppressing strong negative charging is impaired. From all the above it follows that it is preferable to suppress strong negative charging of residual toner and, ideally, to charge residual toner with a weak charging amount. However, it is undesirable to bring the charging amount down to a value close to 0. As a condition for achieving the foregoing, the work function difference between the toner and the recovery sheet member 14 is preferably set to be equal to or greater than 0 eV and equal to or smaller than 0.23 eV.

The present invention allows suppressing strong negative charging of residual toner by relying on a combination such that the value of the work function difference between the toner and the recovery sheet member 14, i.e. (work function of the toner—work function of the recovery sheet member) is equal to or greater than 0 eV and equal to or smaller than 0.23 eV. Further, the effect of suppressing strong negative charging can be maintained over long periods by resorting to an AC charging scheme. As a result, it becomes possible to easily remove residual toner by means of the cleaning member 8, and to suppress the occurrence of vertical streak images.

Embodiments with a more pronounced effect will be explained next.

Embodiment 6 and Embodiment 7, which elicit effects yet more pronounced than Embodiment 1, will be explained next.

In Embodiment 6, the result of the cleaning evaluation is better than in Embodiment 1, and no vertical streak images occur. That is because the recovery sheet member 14 is bonded to the cleaning frame using a double-sided tape, and accordingly the contact pressure of the recovery sheet member 14 against the photosensitive drum 1 is proportionally increased by 1 mm, which is the thickness of the double-sided tape. It is deemed that, through an increase in the contact pressure of the recovery sheet member 14 against the photosensitive drum 1, a layer of residual toner at the contact nip between the recovery sheet member and the photosensitive drum is made uniform, and the rubbing opportunities of the toner and the recovery sheet member 14 increase. It is found that the effect of suppressing strong negative charging of toner is promoted as a result.

Figure 10:
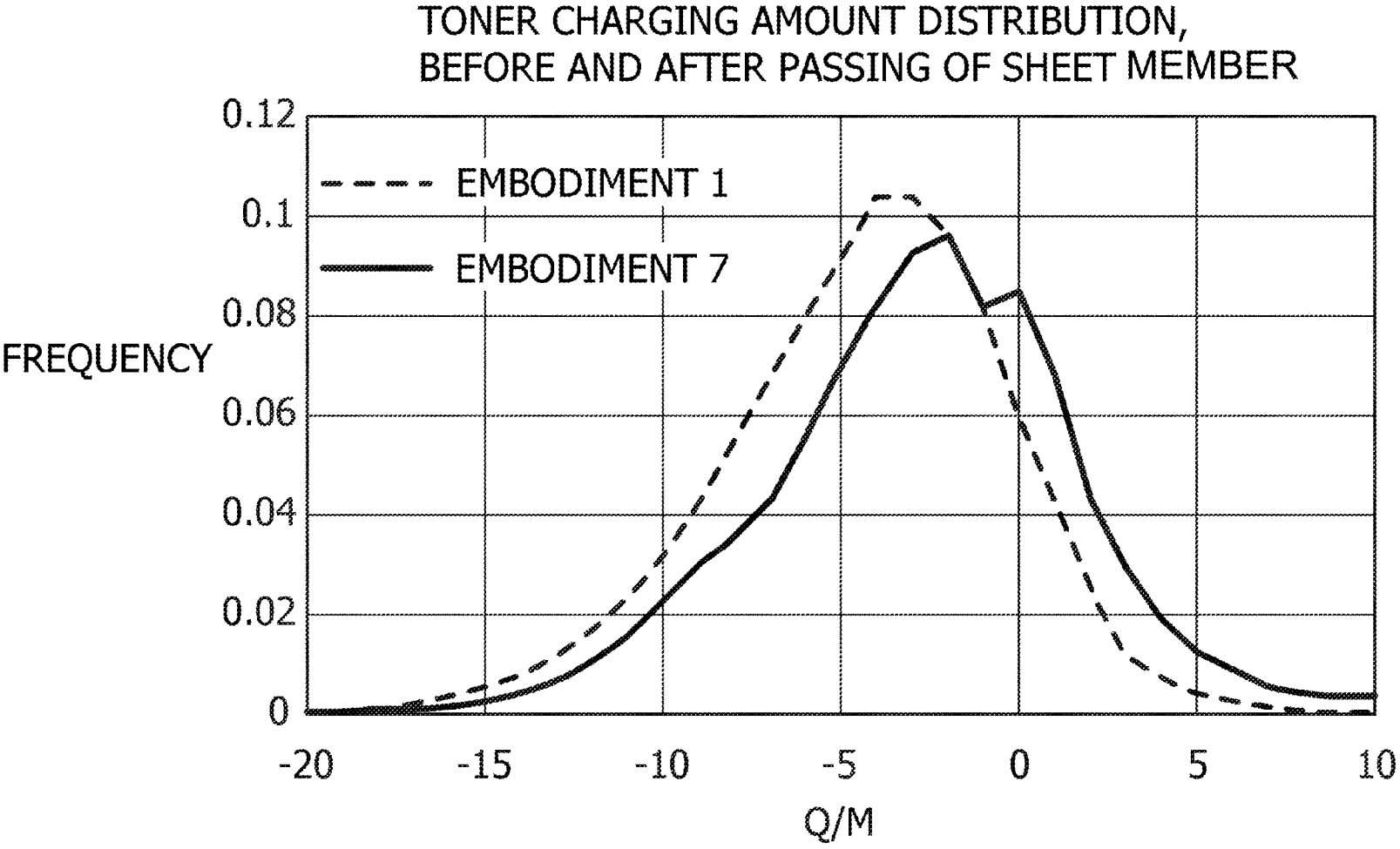
FIG. 10 is a graph representing toner charging amounts in Embodiment 1 and Embodiment 8.

In Embodiment 7 as well, the result of the cleaning evaluation is better than in Embodiment 1, and no vertical streak images occur. This is presumably because the recovery sheet member that is used has a thickness of 50 μm, which translates into an increased contact pressure on the photosensitive drum. Through setting of the thickness of the recovery sheet member 14 to 50 μm the waviness of the recovery sheet member 14 is reduced at the time of affixing thereof to a seat surface of the cleaning frame 15, and it becomes possible to generate a significant contact pressure against the photosensitive drum 1, uniformly over the length thereof. The thickness of the recovery sheet member 14 may be set to be at least 50 μm and not more than 100 μm. That is because using an excessively thick recovery sheet member 14 may result in adverse effects such as damage to the photosensitive drum 1. FIG. 10 illustrates a toner charging amount distribution after passage of the residual toner of Embodiments 1 and 7 by the recovery sheet member 14. As FIG. 10 reveals, in Embodiment 7, the effect of suppressing strong negative charging of toner is promoted through an increase in the contact pressure of the recovery sheet member 14 against the photosensitive drum 1, similarly to Embodiment 6.

Embodiment 8 will be explained next.

Embodiment 8 differs from Embodiment 1 in that herein the AC peak-to-peak voltage value Vpp during non-image forming is set to 1700 V, greater than that during image forming. The result of cleaning evaluation yielded a better image level after the durability test than in the case of Embodiment 1. That is because continued adhesion of toner and external additive to the surface of the recovery sheet member is suppressed by setting a large peak-to-peak voltage Vpp. In Embodiment 8, an optimal Vpp value in order to uniformly charge the photosensitive drum during image forming is used. A large value of Vpp is used such that cleaning of the recovery sheet member 14 is effective, in a state where toner at the time of non-image forming is not on the photosensitive drum. A large peak voltage Vpp entails significant vibration of the photosensitive drum 1, and allows for significant rolling of toner at the contact region between the recovery sheet member and the photosensitive drum. As a result, adhesion of toner on the surface of the recovery sheet member 14 can be suppressed, and the suppression effect on strong negative charging can be maintained.

From the above it follows that, preferably, AC voltage is applied to the charging member by a voltage application means provided in the main body of the image forming apparatus, and a work function W (D) of the developer and a work function W (S) of the recovery sheet member 14 satisfy Relational expression (A) below. As a result, it becomes possible to prevent that residual toner with strong negative charge should reach, as-is, the cleaning member 8. In turn, this allows preventing impairment of images derived from faulty cleaning.

$$0 \leq W(D) - W(S) \leq 0.23 \quad \text{(A)}$$

The present invention is not limited to the features in the above examples. In the examples, one type of material as the recovery sheet member 14 is used, but instead of PPS, a two-layer material having a base material formed of a PET sheet, with a PPS sheet overlaid on the PET sheet may be used for instance. In terms of the material on the surface in contact with the photosensitive drum, the effect of the present invention is elicited so long as the work function difference with respect to that of the toner satisfies Expression (A).

In the above examples the binder resin in toner A is a styrenic resin and the release agent is an ester compound, with a crystalline polyester finely dispersed in the toner. The present invention is however not limited to this toner A. Also in the case of toners that utilize other materials, the effect of the present invention is brought out so long as the work function difference between the toner and the recovery sheet member satisfies Relational expression (A).

In Embodiment 8, Vpp at the time of non-image forming is changed to a value larger than that during image forming. The present invention is not limited to such a feature, and the photosensitive drum can be caused to rotate at a desired timing, with Vpp set to a large value for a desired lapse of time, as a non-image forming operation, to thereby enable cleaning of the toner adhered to the surface of the recovery sheet member.

The present invention can be used in image forming apparatuses such as copiers and printers, as well as in process cartridges that are used in such image forming apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-240051, filed on Dec. 21, 2018, and Japanese Patent Application No. 2018-240046, filed on Dec. 21, 2018 which are hereby incorporated by reference herein in their entirety.

What is claimed is:

1. A cleaning device, comprising:

a cleaning frame;

a cleaning member having one end attached to the cleaning frame and the other end that is a free end, the cleaning member coming into contact with an image bearing member so as to remove developer remaining on the image bearing member after transfer of a developer image from the image bearing member, the image bearing member being capable of rotating and bearing the developer image formed of the developer; and a sheet member having flexibility and having one end attached to the cleaning frame and the other end that comes into contact with the image bearing member at an upstream side of a contact position between the cleaning member and the image bearing member in a rotation direction of the image bearing member;

wherein a work function W (D) of the developer and a work function W (S) of the sheet member satisfy Expression (A) below, and the developer includes inorganic particles, in which at least one kind of the inorganic particles has an average primary particle diameter of 50 nm or larger, $$0 \leq W(D) - W(S) \leq 0.23 \quad \text{(A).}$$

2. The cleaning device according to claim 1, wherein the other end of the sheet member is a free end;

a contact pressure P of the sheet member calculated in accordance with Expression (B) is at least $1.32\times10^{-5}$ and not more than $1.74\times10^{-2}$, where δ is a deflection amount of the sheet member, E is the Young's modulus of the sheet member, h is a thickness of the sheet member, L is a distance from the one end of the sheet member to a contact nip between the sheet member and the image bearing member, and v is the Poisson's ratio of the sheet member, $$P = \delta E h^3 / \{4L^3(1-v^2)\} \quad \text{(B).}$$

3. The cleaning device according to claim 1, wherein the other end of the sheet member is a free end;

a direction extending from the one end of the sheet member to the other end of the sheet member is the same as the rotation direction of the image bearing member at a region where the other end of the sheet member is in contact with the image bearing member.

4. The cleaning device according to claim 1, wherein a direction from the one end of the cleaning member to the other end of the cleaning member is a reverse direction of the rotation direction of the image bearing member at a region where the other end of the cleaning member is in contact with the image bearing member.

5. The cleaning device according to claim 1, wherein a base material of the sheet member is polyphenylene sulfide (PPS).

6. The cleaning device according to claim 1, wherein a base material of the sheet member is polytetrafluoroethylene (PTFE).

7. The cleaning device according to claim 1, wherein the sheet member has a thickness of 50 μm to 100 μm.

8. The cleaning device according to claim 1, wherein the inorganic particles include a silicon oxide particle and a titanium oxide particle.

9. The cleaning device according to claim 1, wherein at least one kind of the inorganic particles has the average primary particle diameter of 50 nm to 200 nm.

10. A process cartridge, comprising:

an image bearing member capable of rotating and bearing a developer image formed of a developer;

a cleaning frame;

a cleaning member having one end attached to the cleaning frame and the other end that is a free end, the cleaning member coming into contact with the image bearing member so as to remove the developer remaining on the image bearing member after transfer of the developer image from the image bearing member; and a sheet member having flexibility and having one end attached to the cleaning frame and the other end that comes into contact with the image bearing member at an upstream side of a contact position between the cleaning member and the image bearing member in a rotation direction of the image bearing member;

wherein a work function W (D) of the developer and a work function W (S) of the sheet member satisfy Expression (A) below and the developer has inorganic particles, in which at least one kind of the inorganic particles has an average primary particle diameter of 50 nm or larger, $$0 \leq W(D) - W(S) \leq 0.23 \quad \text{(A).}$$

11. An image forming apparatus, comprising:

an image bearing member capable of rotating and bearing a developer image formed of a developer;

a transfer member configured to transfer the developer image borne on the image bearing member to a transferring material;

a cleaning frame;

a cleaning member having one end attached to the cleaning frame and the other end that is a free end and coming into contact with the image bearing member so as to remove the developer remaining on the image bearing member after transfer of the developer image from the image bearing member; and a sheet member having flexibility, and having one end attached to the cleaning frame and the other end that comes into contact with the image bearing member at an upstream side of a contact position between the cleaning member and the image bearing member in a rotation direction of the image bearing member;

wherein a work function W (D) of the developer and a work function W (S) of the sheet member satisfy Expression (A) below and the developer has inorganic particles, in which at least one kind of the inorganic particle has an average primary particle diameter of 50 nm or larger, $$0 \leq W(D) - W(S) \leq 0.23 \quad \text{(A),}$$

12. A cleaning device, comprising:

a cleaning frame;

a cleaning member having one end attached to the cleaning frame and the other end that is a free end, the cleaning member coming into contact with an image bearing member so as to remove developer remaining on the image bearing member after transfer of a developer image from the image bearing member, the image bearing member being capable of rotating and bearing the developer image formed of the developer;

a charging member, which is attached to the cleaning frame and which charges the image bearing member; and a sheet member having flexibility and having one end attached to the cleaning frame and the other end that comes into contact with the image bearing member at an upstream side of a contact position between the cleaning member and the image bearing member in a rotation direction of the image bearing member;

wherein an AC voltage is applicable to the charging member; and a work function W (D) of the developer and a work function W (S) of the sheet member satisfy Expression (A) below, $$W(D)-W(S)\leq 0.23 \quad \text{(A).}$$

13. The cleaning device according to claim 12, wherein the other end of the sheet member is a free end;

a contact pressure P of the sheet member calculated in accordance with Expression (B) is at least $1.32\times10^{-5}$ and not more than $1.74\times10^{-2}$, where δ is a deflection amount of the sheet member, E is the Young's modulus of the sheet member, h is a thickness of the sheet member, L is a distance from the one end of the sheet member to a contact nip between the sheet member and the image bearing member, and v is the Poisson's ratio of the sheet member, $$P=\delta Eh^3/\{4L^3(1-v^2)\} \quad \text{(B).}$$

14. The cleaning device according to claim 12, wherein the other end of the sheet member is a free end;

a direction extending from the one end of the sheet member to the other end of the sheet member is the same as the rotation direction of the image bearing member at a region where the other end of the sheet member is in contact with the image bearing member.

15. The cleaning device according to claim 12, wherein a direction from the one end of the cleaning member to the other end of the cleaning member is a reverse direction of the rotation direction of the image bearing member at a region where the other end of the cleaning member is in contact with the image bearing member.

16. The cleaning device according to claim 12, wherein a base material of the sheet member is polyphenylene sulfide (PPS).

17. The cleaning device according to claim 12, wherein a base material of the sheet member is polytetrafluoroethylene (PTFE).

18. The cleaning device according to claim 12, wherein the sheet member has a thickness of 50 μm to 100 μm.

19. The cleaning device according to claim 12, wherein, the sheet member, which is attached to the cleaning frame constituting an accommodating part that accommodates the developer removed by the cleaning member, and which also functions as a sealing member to prevent the developer removed by the cleaning member from leaking out of the accommodating part.

20. The cleaning device according to claim 12, wherein, the charging member is applied with an AC voltage during a non-image forming state, a peak-to-peak voltage value of the AC voltage applied during the non-image forming state is greater than that during an image forming state.

21. The cleaning device according to claim 12, wherein the developer contains an external additive.

22. A cartridge attachable to and detachable from a main body of an image forming apparatus, the cartridge comprising:

an image bearing member capable of rotating and bearing a developer image formed of a developer;

a cleaning frame;

a cleaning member having one end attached to the cleaning frame and the other end that is a free end, the cleaning member coming into contact with the image bearing member so as to remove the developer remaining on the image bearing member after transfer of the developer image from the image bearing member;

a charging member attached to the cleaning frame and which charges the image bearing member; and a sheet member having flexibility and having one end attached to the cleaning frame and the other end that comes into contact with the image bearing member at an upstream side of a contact position between the cleaning member and the image bearing member in the rotation direction of the image bearing member;

wherein an AC voltage is applicable to the charging member; and a work function W (D) of the developer and a work function W (S) of the sheet member satisfy Expression (A) below, $$0\leq W(D)-W(S)\leq 0.23 \quad \text{(A).}$$

23. An image forming apparatus, comprising:

an image bearing member capable of rotating and bearing a developer image formed of a developer;

a transfer member that transfers the developer image borne on the image bearing member to a transferring material;

a cleaning frame;

a cleaning member having one end attached to the cleaning frame and the other end that is a free end, the cleaning member coming into contact with the image bearing member so as to remove the developer remaining on the image bearing member after transfer of the developer image from the image bearing member;

a charging member attached to the cleaning frame and which charges the image bearing member; and a sheet member having flexibility and having one end attached to the cleaning frame and the other end that comes into contact with the image bearing member at an upstream side of a contact position between the cleaning member and the image bearing member in a rotation direction of the image bearing member;

wherein an AC voltage is applicable to the charging member; and a work function W (D) of the developer and a work function W (S) of the sheet member satisfy Expression (A) below, $$0\leq W(D)-W(S)\leq 0.23 \quad \text{(A)}$$

* * * * *